US010010174B2

(12) United States Patent
Chen et al.

(10) Patent No.: US 10,010,174 B2
(45) Date of Patent: Jul. 3, 2018

(54) MOUNTING MECHANISM

(71) Applicants: KING SLIDE WORKS CO., LTD., Kaohsiung (TW); KING SLIDE TECHNOLOGIES CO., LTD., Kaohsiung (TW)

(72) Inventors: Ken-Ching Chen, Kaohsiung (TW); Fang-Cheng Su, Kaohsiung (TW); Shih-Lung Huang, Kaohsiung (TW); Ci-Bin Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 15/288,134

(22) Filed: Oct. 7, 2016

(65) Prior Publication Data

US 2017/0135473 A1 May 18, 2017

(30) Foreign Application Priority Data

Nov. 12, 2015 (TW) ..... 104137456 A
Jul. 1, 2016 (TW) ..... 105121079 A

(51) Int. Cl.
*A47B 88/95* (2017.01)
*A47B 88/956* (2017.01)

(52) U.S. Cl.
CPC ..... *A47B 88/95* (2017.01); *A47B 88/956* (2017.01); *A47B 2088/951* (2017.01); *A47B 2088/952* (2017.01); *A47B 2088/953* (2017.01); *A47B 2088/954* (2017.01); *A47B 2088/955* (2017.01)

(58) Field of Classification Search
CPC ..... A47B 88/95; A47B 2088/951–2088/956; A47B 88/956
USPC ..... 312/348.4
See application file for complete search history.

(56) References Cited

U.S. PATENT DOCUMENTS 5,505,554 A * 4/1996 Lautenschlager .... A47B 88/956 312/348.2
5,540,515 A * 7/1996 Rock ..... A47B 88/95 292/341.17
5,860,718 A * 1/1999 Brustle ..... A47B 88/95 312/330.1
7,540,577 B2 * 6/2009 Netzer ..... A47B 88/956 312/348.4
8,297,724 B2 10/2012 Hammerle
(Continued)

FOREIGN PATENT DOCUMENTS

CA 2829536 A1 * 10/2014 ..... A47B 88/0407
DE 29914388 U1 * 12/1999 ..... A47B 88/95
(Continued)

*Primary Examiner* — Eret C McNichols
(74) *Attorney, Agent, or Firm* — Rosenberg, Klein & Lee

(57) ABSTRACT

A mounting mechanism adapted for mounting at least one first component to a second component includes a base, a movable member, and a transmission device. The base is mounted on the second component. The movable member is movably mounted on the base and includes a holding portion to which the at least one first component can be mounted. The transmission device is configured to displace the movable member from a first position to a second position in response to the least one first component being mounted to the holding portion of the movable member.

25 Claims, 19 Drawing Sheets

(56) References Cited

U.S. PATENT DOCUMENTS

| | | | | |
|---|---|---|---|---|
| 8,727,461 | B2 | 5/2014 | Holzapfel et al. | |
| 9,028,019 | B2 * | 5/2015 | Holzapfel | A47B 88/0055 312/348.4 |
| 9,033,436 | B2 * | 5/2015 | Holzapfel | A47B 88/0055 312/348.4 |
| 9,386,848 | B2 * | 7/2016 | Holzapfel | A47B 88/0051 |
| 9,464,652 | B2 * | 10/2016 | Holzapfel | F16B 12/02 |
| 9,480,335 | B2 * | 11/2016 | Ng | A47B 88/0051 |
| 2007/0228906 | A1 * | 10/2007 | Netzer | A47B 88/956 312/348.4 |
| 2014/0070687 | A1 | 3/2014 | Holzapfel et al. | |
| 2014/0072366 | A1 | 3/2014 | Holzapfel et al. | |
| 2014/0077677 | A1 | 3/2014 | Holzapfel et al. | |
| 2014/0252936 | A1 | 9/2014 | Holzapfel | |
| 2014/0312756 | A1 * | 10/2014 | Ng | A47B 88/0407 312/334.5 |
| 2017/0265645 | A1 * | 9/2017 | Kruger | A47B 88/956 |

FOREIGN PATENT DOCUMENTS

| | | | | |
|---|---|---|---|---|
| DE | 202015102087 | U1 * | 7/2015 | A47B 88/956 |
| DE | 202016101367 | U1 * | 3/2016 | A47B 88/95 |
| DE | 102015102771 | A1 * | 9/2016 | |
| EP | 0451113 | A1 * | 10/1991 | A47B 88/956 |
| EP | 0740917 | B1 * | 11/1998 | A47B 88/95 |
| EP | 1297765 | A1 * | 4/2003 | A47B 88/95 |
| EP | 2374370 | A1 * | 10/2011 | A47B 88/956 |
| EP | 2059145 | B1 * | 10/2016 | A47B 88/95 |
| FR | 3012306 | B1 * | 12/2016 | A47B 88/956 |
| WO | WO-2010115346 | A1 * | 10/2010 | A47B 88/95 |
| WO | WO-2012171047 | A1 * | 12/2012 | F16B 12/02 |

* cited by examiner

MOUNTING MECHANISM

FIELD OF THE INVENTION

The present invention relates to a mounting mechanism and more particularly to one that is adapted for use with furniture components and configured to mount at least one first component to a second component in a detachable manner.

BACKGROUND OF THE INVENTION

Generally, a drawer or cabinet includes a plurality of sidewalls and panels. These sidewalls and panels define a storage space therebetween. As market demands diversify, the sidewalls and panels (e.g., a front panel) of a drawer or cabinet can nowadays be put together through mechanism design. For instance, U.S. Pat. Nos. 8,297,724 B2 and 8,727,461 B2 and US Patent Publication Nos. 2014/0070687 A1, 2014/0072366 A1, 2014/0077677 A1, and 2014/0252936 A1 disclose a drawer sidewall or lateral frame member to which the front panel of a drawer can be mounted releasably. The aforementioned patent documents are incorporated herein by reference.

According to the tool-free mounting structures disclosed in the prior art, the front panel and sidewalls of a drawer may have problem being securely assembled together if the errors of assembly exceed the tolerable range.

SUMMARY OF THE INVENTION

The present invention relates to a mounting mechanism for detachably mounting at least one first component to a second component without using tools.

According to one aspect of the present invention, a mounting mechanism adapted for mounting at least one first component to a second component includes a base, a transmission device, and a movable member. The base is mountable on the second component. The transmission device is arranged at the base. The movable member is movably connected to the transmission device and is configured to be displaced with respect to the base from a first position to a second position in response to displacement between the at least one first component and the second component in a predetermined direction, thereby mounting the at least one first component to the second component.

According to another aspect of the present invention, a mounting mechanism adapted for mounting at least one first component to a second component includes a base, a movable member, and a transmission device. The base is mounted on the second component. The movable member is movably mounted on the base and includes a holding portion to which the at least one first component can be mounted. The transmission device is configured to displace the movable member from a first position to a second position in response to the at least one first component being mounted to the holding portion of the movable member.

According to still another aspect of the present invention, a mounting mechanism is adapted for use in a system which includes a main body and an object mounted to the main body via a slide rail assembly. The slide rail assembly includes a first rail and a second rail displaceable with respect to the first rail. The object includes a sidewall and a panel. The sidewall is arranged at the second rail. The panel is mounted to a second component of the sidewall via at least one first component. The mounting mechanism includes a base, a movable member, a transmission device, a first linking member, and a second linking member. The base is mounted on the second component. The movable member is mounted on the base and includes a rack. The transmission device is configured to displace the movable member from a first position to a second position in response to the at least one first component being mounted to the movable member. The transmission device includes a first transmission member with a plurality of first teeth and a second transmission member with a plurality of second teeth. The first teeth of the first transmission member mesh with the rack of the movable member. The first linking member is pivotally connected to the base and includes a plurality of teeth meshing with the second teeth of the second transmission member. The second linking member is connected to the first linking member. Moreover, the second linking member is connected to a connecting rod, and there is an elastic member mounted on the connecting rod and configured to apply an elastic force to the movable member.

In some embodiments according to any one of the foregoing aspects, the transmission device includes a first transmission member with a plurality of first teeth, and the movable member includes a rack meshing with the first teeth of the first transmission member.

Preferably, the mounting mechanism further includes a connecting rod and an elastic member. The connecting rod is mounted on the base. The elastic member is mounted on the connecting rod and is configured to apply an elastic force to the movable member.

Preferably, the mounting mechanism further includes an extension wall connected to the base and having a mounting feature, and the connecting rod has a head and a body connected to the head. The body is movably connected to the mounting feature while the elastic member is pressed between the extension wall and the head.

Preferably, the transmission device further includes a second transmission member with a plurality of second teeth, and the mounting mechanism further includes a first linking member and a second linking member. The first liking member is pivotally connected to the base and includes a plurality of teeth meshing with the second teeth of the second transmission member. The second linking member is movably connected between the first linking member and the head of the connecting rod.

Preferably, the second linking member further includes a manual operation portion with which to adjust the second linking member manually in order to bring the movable member from the second position to the first position with respect to the base.

Preferably, the mounting mechanism further includes a stop wall adjacent to the second linking member. The stop wall stops the second linking member in response to an external force applied to the at least one first component in the opposite direction of the predetermined direction.

Preferably, the mounting mechanism further includes a stopping feature arranged at the base. When the second linking member is at a predetermined position, the manual operation portion of the second linking member corresponds in position to the stopping feature.

Preferably, the movable member includes a guiding portion, and the mounting mechanism further includes a protruding member. The guiding portion has a first channel and a second channel, wherein the second channel is in communication with and is tilted by an angle with respect to the first channel. The protruding member selectively extends through a corresponding one of the first channel and the second channel. When the protruding member corresponds to the second channel, the movable member is at the first position with respect to the base.

Preferably, the movable member further includes a holding portion, and the at least one first component has an auxiliary portion. The holding portion includes an engaging section and a guiding surface adjacent to the engaging section. The auxiliary portion is configured to push the guiding surface of the movable member and be engageably mounted to the engaging section.

Preferably, the at least one first component includes two corresponding longitudinal walls and an auxiliary portion connected between the two longitudinal walls, one of the two longitudinal walls of the at least one first component has a post, and the auxiliary portion can be mounted to the movable member. In addition, a first adjusting member is arranged at the at least one first component and includes an adjusting portion, a pushing portion, and a threaded feature. The threaded feature is connected between the adjusting portion and the pushing portion and can be threadedly connected to the post. The pushing portion corresponds to the base. The at least one first component can be displaced in a transverse direction according to adjustment of the first adjusting member.

Preferably, the base includes a first hole and a second hole, and the mounting mechanism further includes a guiding member and a second adjusting member. The shape of the second hole is substantially perpendicular to the shape of the first hole. The guiding member has a connecting portion and a stop connected to the connecting portion. The connecting portion extends through the first hole and is connected to the second component such that the stop is stopped on one side of the base. The second adjusting member corresponds to the second hole of the base and includes an adjusting portion, a pivotal connection portion, and an eccentric portion connected between the adjusting portion and the pivotal connection portion of the second adjusting member. The adjusting portion and the pivotal connection portion have a common axis. The pivotal connection portion is pivotally connected to the second component. The eccentric portion is eccentric with respect to the axis and is configured to push the base in order to displace the base according to the shape of the first hole.

Preferably, the at least one first component is a first furniture component, and the second component is a second furniture component.

Preferably, the movable member is connected to the transmission device in a meshing manner.

Preferably, the movable member includes two holding portions to which two first components can be respectively and engageably mounted.

Preferably, each of the holding portions includes an engaging section and a guiding surface adjacent to the engaging section, and each of the two first components has an auxiliary portion for pushing a corresponding one of the guiding surfaces of the movable member and to be engageably mounted to a corresponding one of the engaging sections.

Preferably, the movable member includes two guiding portions, and the mounting mechanism further includes a protruding member and a rod member. Each of the guiding portions has a first channel and a second channel. The second channel is in communication with and is tilted by an angle with respect to the first channel. The protruding member and the rod member extend through the two guiding portions respectively. When the protruding member and the rod member correspond respectively to the second channels, the movable member is at the first position with respect to the base.

Preferably, the mounting mechanism further includes a driving device mounted on the second component and having a pushing member. The two first components drive the driving device when displaced in the predetermined direction; as a result, the movable member is displaced from the first position toward the second position in response to the pushing action of the pushing member of the driving device.

Preferably, the driving device further includes a driving member. Both the driving member and the pushing member are pivotally connected to the second component. The pushing member is movably connected to the driving member. The driving member is configured to be driven by the two first components in order to drive the pushing member.

One of the advantageous features of the present invention is that the transmission device can displace the movable member from the first position to the second position and thereby mount the first component, which is mounted on the movable member, to the second component.

DETAILED DESCRIPTION OF THE INVENTION

Figure 1:
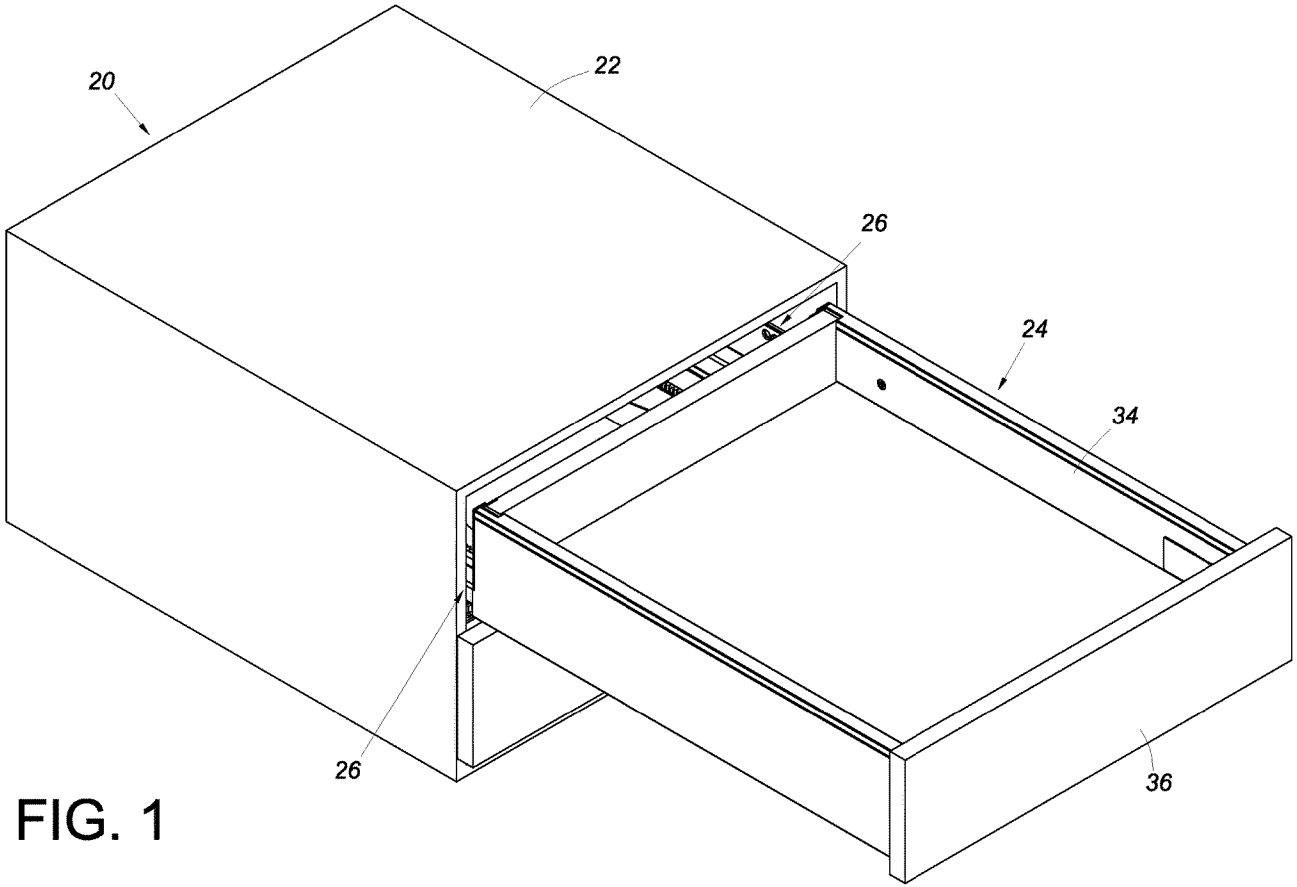
FIG. 1 is a perspective view of the system in an embodiment of the present invention, wherein the system includes a main body and at least on object which can be displaced with respect to the main body through a pair of slide rail assemblies.

Referring to FIG. 1, the system 20 in an embodiment of the present invention includes a main body 22 and at least one object 24 to be carried by the main body 22 (hereinafter referred to as the object 24). The system 20 may be a furniture-related system or cabinet-related system. In this embodiment, the system 20 includes two objects 24, which are implemented as drawers by way of example. For the sake of simplicity, the following description refers to only one of the two objects 24. A pair of slide rail assemblies 26 are mounted between the main body 22 and the object 24. The slide rail assemblies 26 in this embodiment are undermount drawer slides, and each slide rail assembly 26 is mounted adjacent to a lateral bottom portion of the object 24. This arrangement allows the object 24 to be pulled out of and pushed back into the main body 22 with ease.

Figure 2:
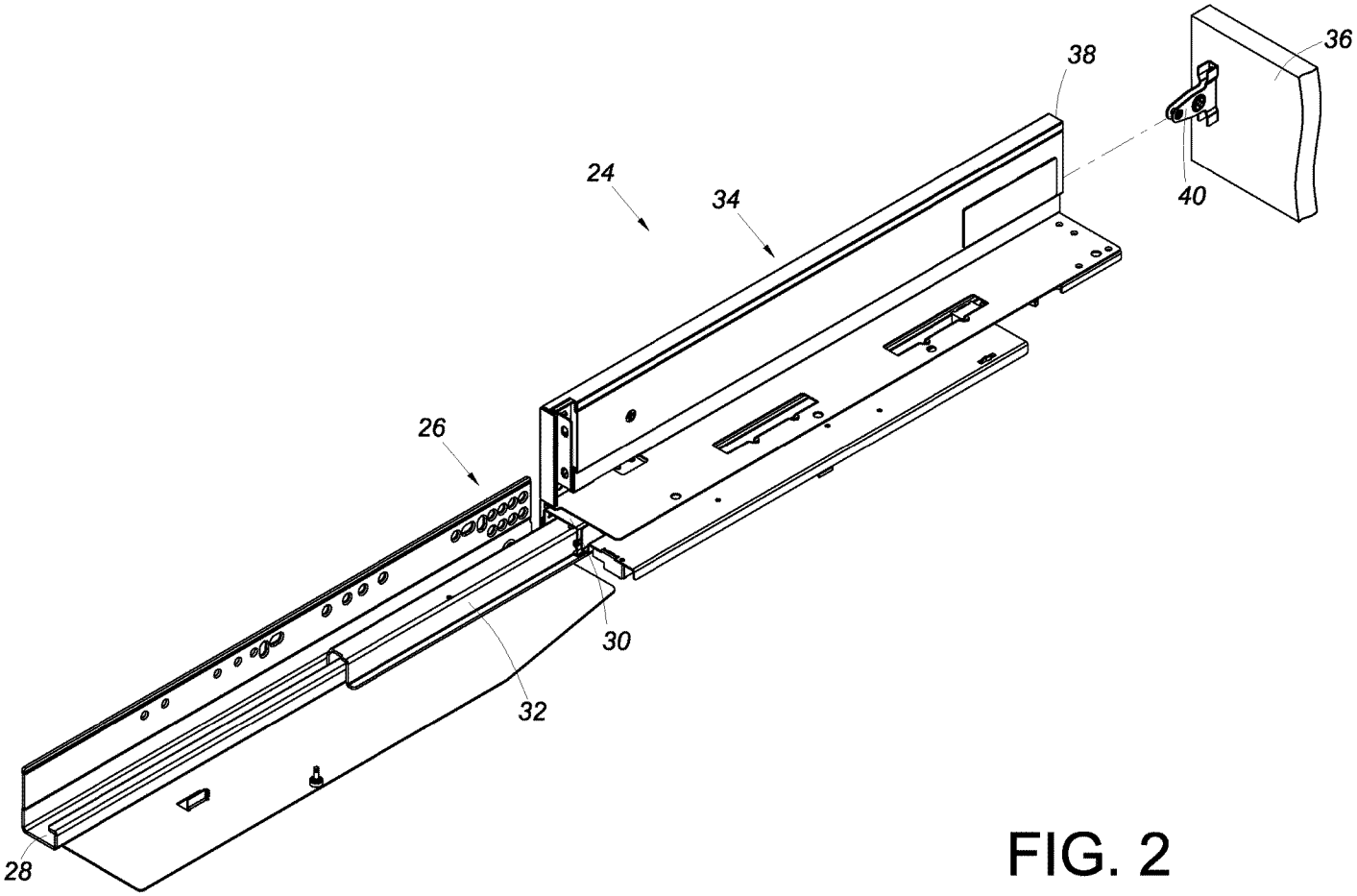
FIG. 2 is a perspective view of one of the slide rail assemblies in FIG. 1, showing that a sidewall of the object is arranged at a rail of the slide rail assembly, and that a panel of the object includes a first component.

As shown in FIG. 2, the slide rail assembly 26 includes a first rail 28 and a second rail 30 which can be longitudinally displaced with respect to the first rail 28. Preferably, the slide rail assembly 26 further includes a third rail 32 arranged between the first rail 28 and the second rail 30 to increase the distance by which the second rail 30 can be displaced with respect to the first rail 28. The object 24 at least includes a sidewall 34 arranged at the second rail 30 and a panel 36 detachably mounted on the sidewall 34. Once mounted on the sidewall 34, the panel 36 is arranged at a front end portion 38 of the sidewall 34. In addition, a first component 40 is fixedly arranged at the panel 36 beforehand and therefore can be viewed as a part of the panel 36 and as a first furniture component. The first component 40 is configured to mount the panel 36 to the sidewall 34, as explained in more detail below.

Figure 3:
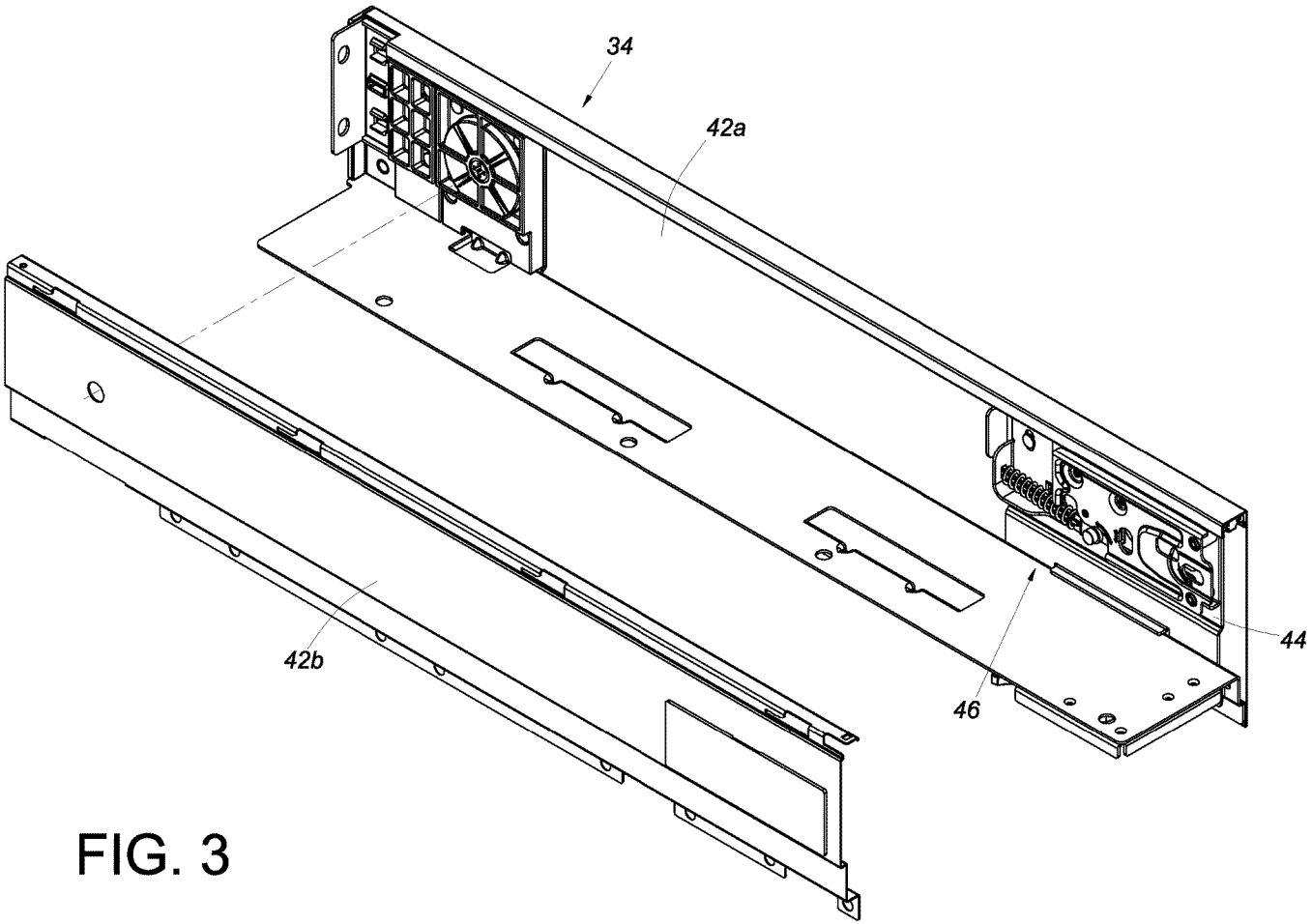
FIG. 3 is an exploded perspective view of the sidewall in FIG. 2, showing the mounting mechanism mounted in the sidewall.

As shown in FIG. 3, the sidewall 34 includes a plurality of wall portions assembled together, such as a first wall portion 42*a* and a second wall portion 42*b* mounted on the first wall portion 42*a*. Also, a second component 44 is fixedly arranged at the sidewall 34 beforehand and therefore can be viewed as a part of the sidewall 34 and as a second furniture component. In this embodiment, the second component 44 is arranged at the first wall portion 42*a* of the sidewall 34 by way of example.

Figure 4:
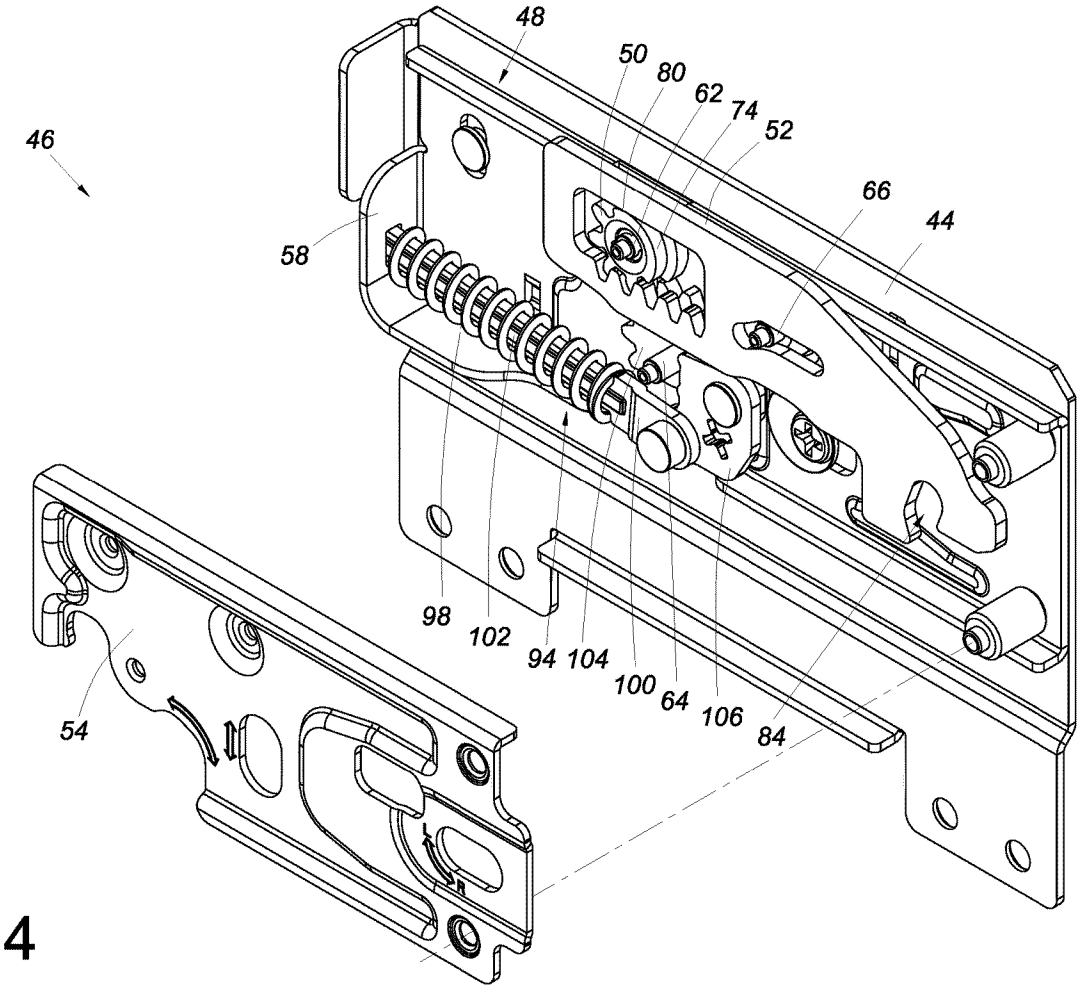
FIG. 4 is a perspective view showing the arrangement of components of the mounting mechanism in FIG. 3.

As shown in FIG. 4, the mounting mechanism 46 in this embodiment includes a base 48, a transmission device 50, and a movable member 52. Preferably, the mounting mechanism 46 further includes a housing 54 covering the base 48. The housing 54 may have related operation symbols on its surface in order for an operator to identify the functions provided by the mounting mechanism 46.

Figure 5:
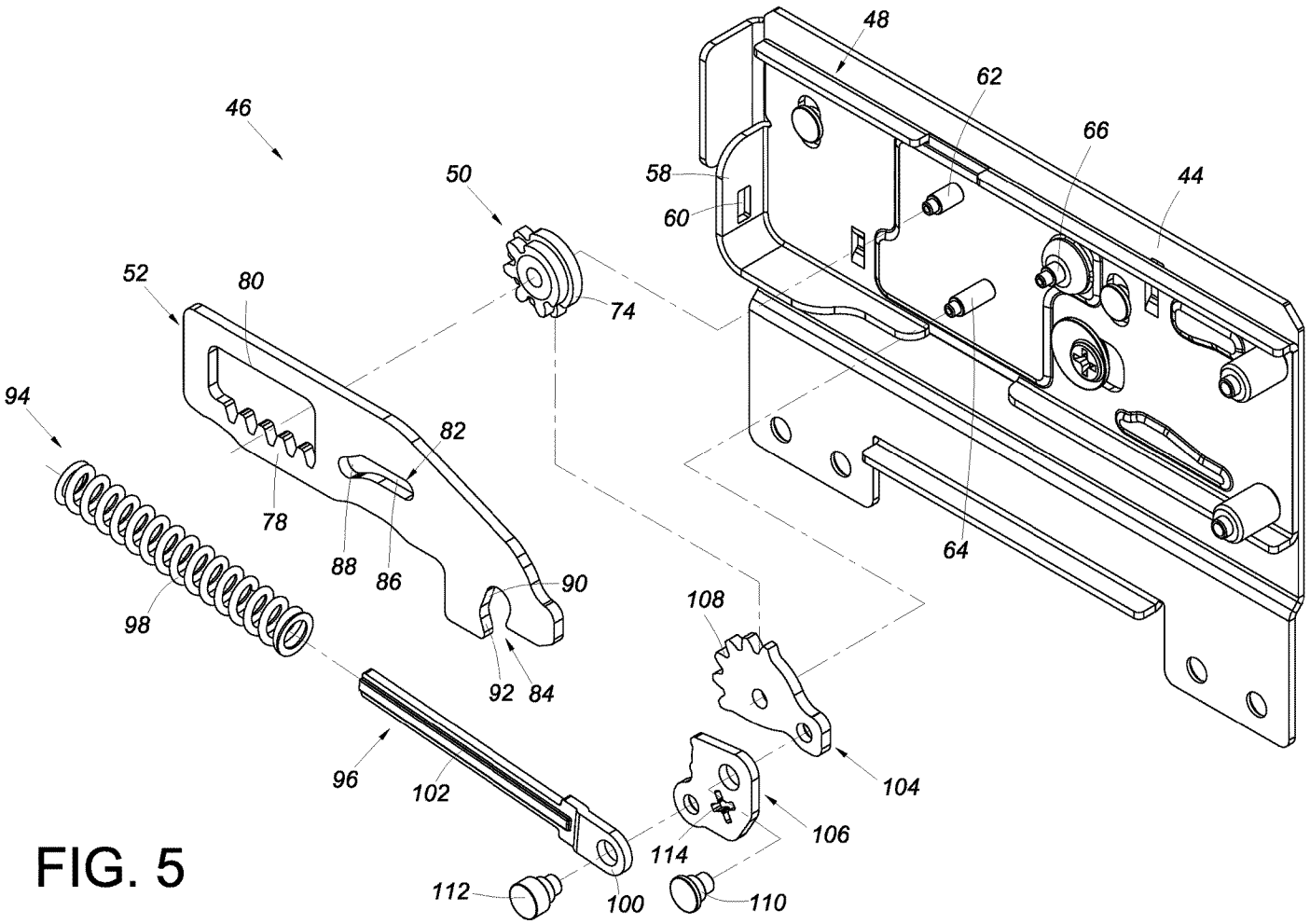
FIG. 5 is an exploded perspective view of the mounting mechanism in FIG. 4.

As shown in FIG. 4 and FIG. 5, the base 48 is mounted on the second component 44. The base 48 has an extension wall 58 substantially perpendicularly connected to the base 48. The extension wall 58 has a mounting feature 60, such as a hole. Preferably, the base 48 further includes a first supporting member 62, a second supporting member 64, and a protruding member 66, all connected to the base 48. In this embodiment, both the first supporting member 62 and the second supporting member 64 are cylindrical. The transmission device 50 is arranged at the base 48. More specifically, the first supporting member 62 is inserted into the transmission device 50 so that the transmission device 50 can be pivoted with respect to the base 48. The transmission device 50 has a pressing section 74. The movable member 52 is movably connected to the transmission device 50 and can be displaced with respect to the base 48. The movable member 52 includes a rack 78, a pressing portion 80, a guiding portion 82, and a holding portion 84. The rack 78 meshes with the transmission device 50. The pressing portion 80 is pressed against the pressing section 74 of the transmission device 50. The guiding portion 82 is inserted by the protruding member 66 on the base 48 and has a first channel 86 and a second channel 88. The second channel 88 is in communication with the first channel 86 and is tilted by an angle with respect to the first channel 86. The holding portion 84 includes an engaging section 90 and a guiding surface 92 adjacent to the engaging section 90.

The mounting mechanism 46 further includes an operation device 94. The operation device 94 includes a connecting rod 96 and an elastic member 98. The elastic member 98 can apply an elastic force to the movable member 52 through the connecting rod 96. More specifically, the connecting rod 96 has a head 100 and a body 102 connected to the head 100. A portion of the body 102 extends out of the mounting feature 60 of the extension wall 58. The elastic member 98 is inserted by the body 102 and is pressed between the extension wall 58 and the head 100. In addition, a first linking member 104 and a second linking member 106 are movably arranged between the connecting rod 96 and the transmission device 50. More specifically, the second supporting member 64 is inserted into the first linking member 104 so that the first linking member 104 can be pivoted with respect to the base 48. The first linking member 104 includes a plurality of teeth 108 configured to mesh with the transmission device 50. The second linking member 106 is movably connected between the connecting rod 96 and the first linking member 104. The second linking member 106 can be connected to the first linking member 104 by a first connecting member 110 and to the head 100 of the connecting rod 96 by a second connecting member 112. Preferably, the second linking member 106 includes a manual operation portion 114 allowing an operator to manually adjust the second linking member 106 with a tool.

Figure 6:
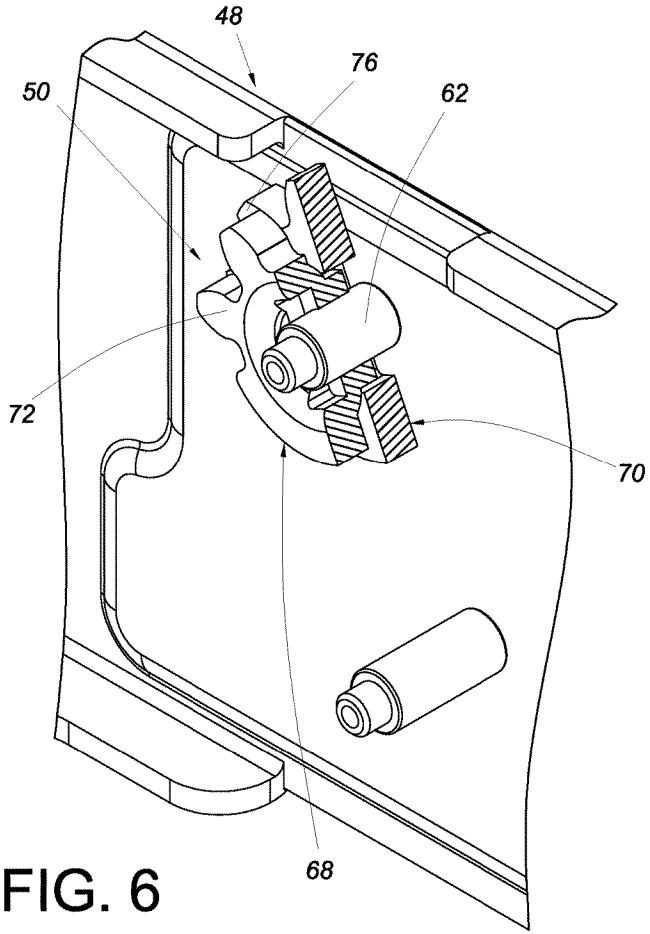
FIG. 6 is a perspective view showing how the transmission device of the mounting mechanism in FIG. 4 is arranged at the base.

As shown in FIG. 6, the transmission device 50 is mounted around the first supporting member 62 on the base 48. The transmission device 50 includes a first transmission member 68 and a second transmission member 70. The first transmission member 68 and the second transmission member 70 may be integrally formed, or the two transmission members 68, 70 may be two separate components connected by a connecting means such as mechanical engagement, fastening, or adhesive bonding. It is noted that the connecting means for connecting the two transmission member 68, 70 is not limited. The first transmission member 68 has a plurality of first teeth 72, and the second transmission member 70 has a plurality of second teeth 76.

Figure 7:
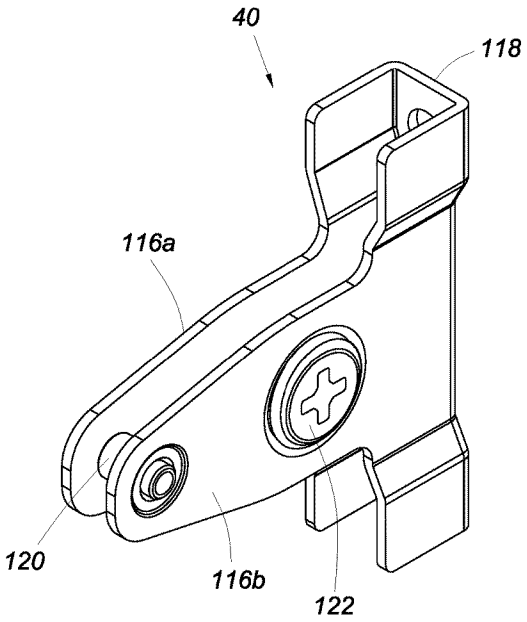
FIG. 7 is a perspective view of the first component in FIG. 2.

As shown in FIG. 7, the first component 40 includes a first longitudinal wall 116*a*, a second longitudinal wall 116*b*, and a transverse wall 118 connected between the two longitudinal walls 116*a*, 116*b*. Preferably, an auxiliary portion 120 is also connected between the two longitudinal walls 116*a*, 116*b*, and a first adjusting member 122 is arranged at one of the two longitudinal walls 116*a*, 116*b*. As shown in FIG. 7 and FIG. 2, the transverse wall 118 can be connected to the panel 36 of the object 24.

Figure 8:
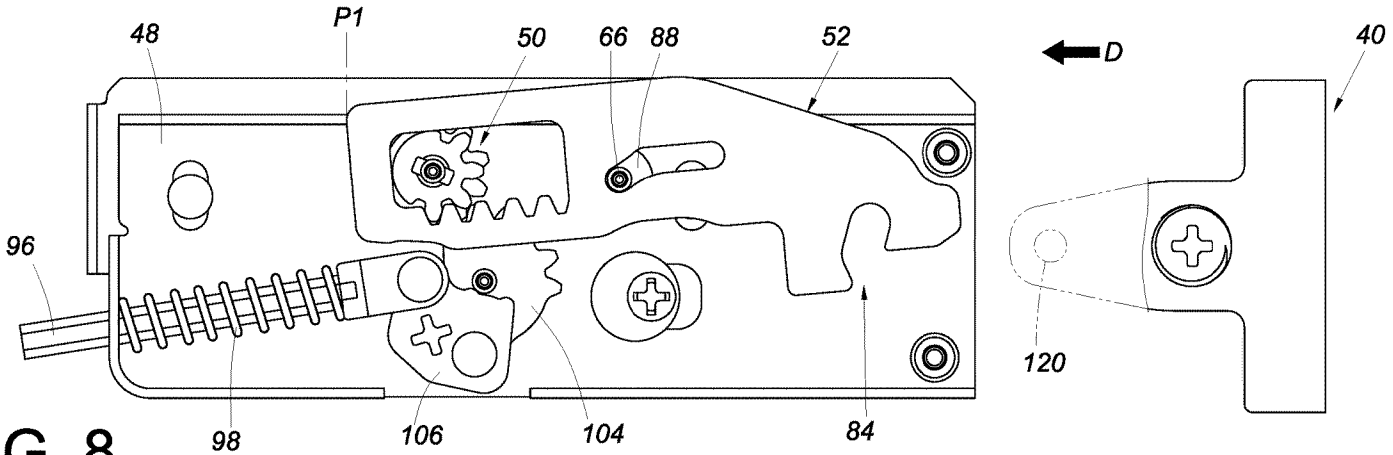
FIG. 8 schematically shows the mounting mechanism in FIG. 4 in a predetermined state, with the first component corresponding to the movable member of the mounting mechanism.
Figure 9:
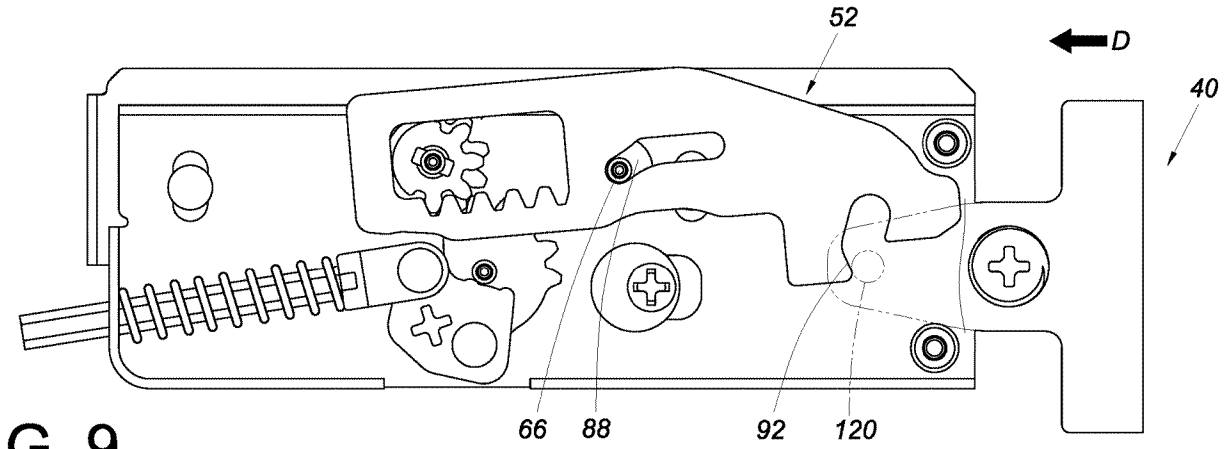
FIG. 9 is similar to FIG. 8, showing the first step of mounting the first component to the mounting mechanism.

Referring to FIG. 8 and FIG. 9, when the protruding member 66 corresponds to the second channel 88 of the movable member 52, the movable member 52 is at a first position P1 with respect to the base 48 for the time being. The movable member 52 in this state is tilted with respect to the base 48. On the other hand, the transmission device 50, the first linking member 104, the second linking member 106, the connecting rod 96, and the elastic member 98 are each in a predetermined state with respect to the movable member 52. The elastic member 98 in this predetermined state may store an elastic force if so configured. Referring to FIGS. 8 and 9 in conjunction with FIG. 2, when it is desired to mount the panel 36 of the object 24 to the sidewall 34, an operator moves the first component 40 on the panel 36 in a predetermined direction D. The auxiliary portion 120 of the first component 40 pushes the guiding surface 92 of the movable member 52 while being moved in the direction D.

Figure 10:
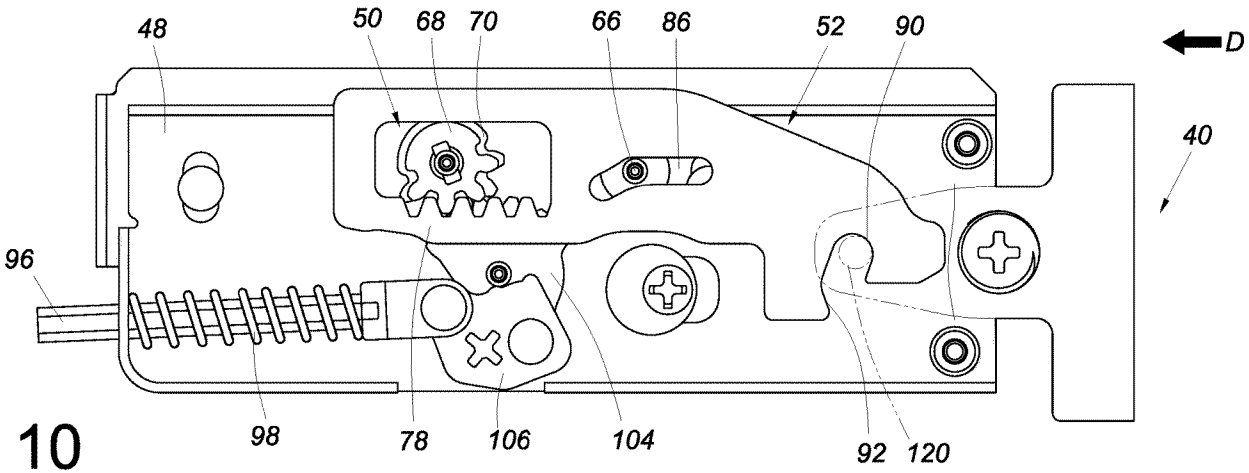
FIG. 10 is similar to FIG. 9, showing the second step of mounting the first component to the mounting mechanism.
Figure 11:
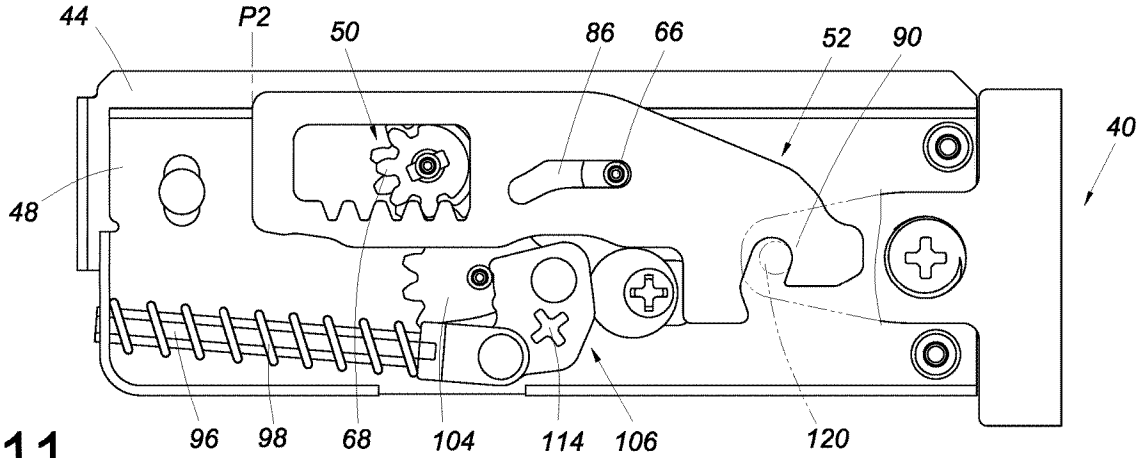
FIG. 11 is similar to FIG. 10, showing the third step of mounting the first component to the mounting mechanism.

Referring to FIG. 10 and FIG. 11, as the auxiliary portion 120 of the first component 40 continues pushing the guiding surface 92 of the movable member 52 in the direction D, the movable member 52 is displaced in the same direction from the first position P1 such that the protruding member 66 can correspond to the first channel 86 of the movable member 52. The movable member 52 in this state is no longer tilted with respect to the base 48, and this allows the first component 40 to be mounted to the movable member 52. In this embodiment, the first component 40 is engageably mounted to the engaging section 90 of the movable member 52 via the auxiliary portion 120, and during the process, the rack 78 of the movable member 52 drives the first transmission member 68 of the transmission device 50. The second transmission member 70, in turn, drives the first linking member 104, the second linking member 106, and the connecting rod 96 in response to transmission by the first transmission member 68. Once the connecting rod 96 is driven from the aforesaid predetermined state to a certain position, the movable member 52 is automatically displaced from the first position P1 to a second position P2 with respect to the base 48 by the elastic force released by the elastic member 98. More specifically, the movable member 52 is displaced in the direction D toward the second position P2 (see FIG. 10) thanks to the rack 78 meshing with the first transmission member 68 of the transmission device 50. When the movable member 52 reaches the second position P2 (see FIG. 11), the first component 40 is securely mounted on the second component 44. That is to say, the transmission device 50 can drive the movable member 52 from a first position to a second position in response to the first component 40 being mounted to the engaging section 90 of the holding portion 84 of the movable member 52.

When it is desired to remove the first component 40 from the second component 44, the operator may insert a tool, such as a screw driver, into the manual operation portion 114 of the second linking member 106 and then adjust the second linking member 106 manually with the tool, thereby driving the connecting rod 96, the first linking member 104, the transmission device 50, and the movable member 52 sequentially, displacing the movable member 52 from the second position P2 toward the first position P1 with respect to the base 48 in the opposite direction of the direction D. When the movable member 52 is displaced to the first position P1, the auxiliary portion 120 of the first component 40 can be disengaged from the engaging section 90 of the holding portion 84 of the movable member 52 (the principle of the disengaging operation can be easily understood by referring sequentially to FIG. 11, FIG. 10, FIG. 9, and FIG. 8 and is therefore omitted herein for the sake of simplicity).

Figure 12:
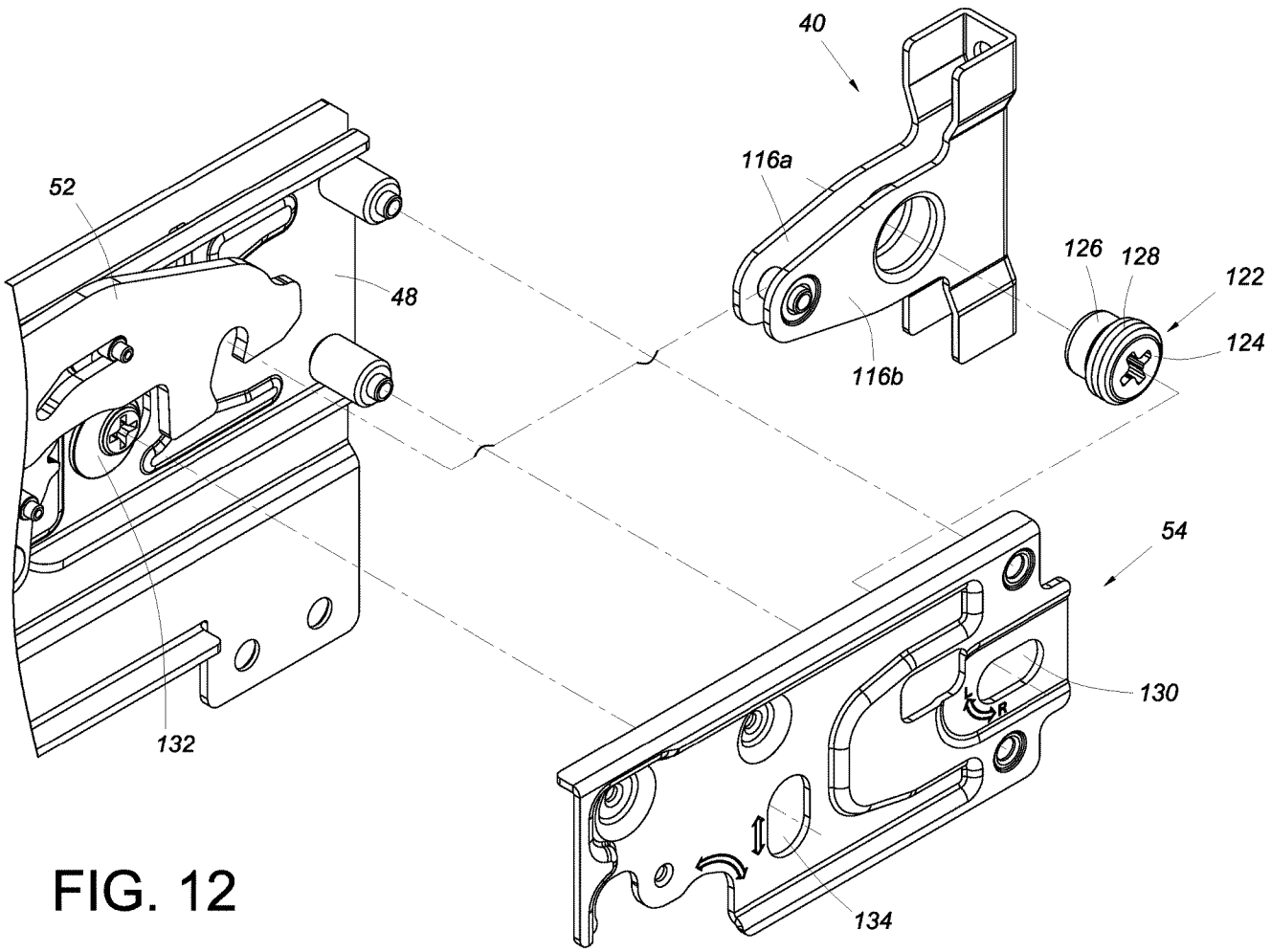
FIG. 12 is an exploded perspective view of the base, the first component, and the housing in the embodiment of FIG. 1, showing in particular the first adjusting member and the second adjusting member, which are arranged at the first component and the base respectively.

As shown in FIG. 12, the first component 40 can be mounted to the movable member 52, and the housing 54 can be assembled to and thereby cover the base 48. Moreover, the first adjusting member 122 arranged at the first component 40 includes an adjusting portion 124, a pushing portion 126, and a threaded feature 128 connected between the adjusting portion 124 and the pushing portion 126. The adjusting portion 124 is designed to correspond to a first operation hole 130 of the housing 54. The pushing portion 126 is configured to pass through the two longitudinal walls 116*a*, 116*b* and correspond to the base 48. Preferably, the mounting mechanism 46 further includes a second adjusting member 132 mounted on the base 48, and an operator can adjust the second adjusting member 132 through a second operation hole 134 of the housing 54.

Figure 14:
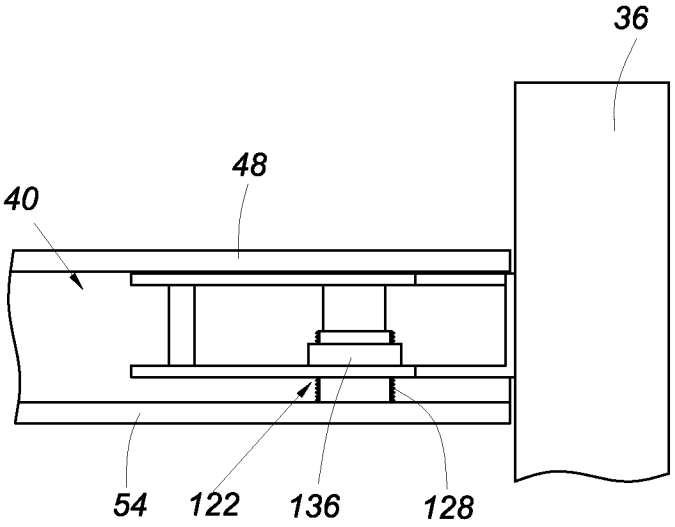
FIG. 14 is a schematic drawing in which the panel in FIG. 13 is adjusted to another position with respect to the base.
Figure 13:
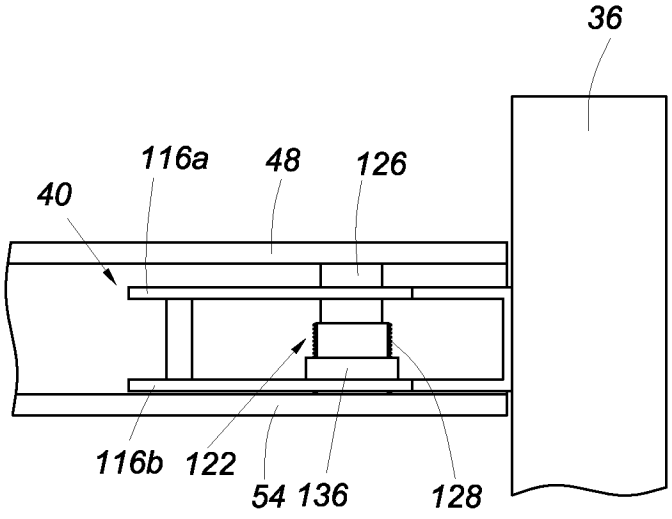
FIG. 13 is a schematic drawing in which the panel of the object in FIG. 2 is adjusted to a certain position with respect to the base.

As shown in FIG. 13 and FIG. 14, the first adjusting member 122 arranged at the first component 40 allows the panel 36 to be adjusted transversely, or laterally, in position. More specifically, one of the two longitudinal walls 116*a*, 116*b* of the first component 40 has a post 136 with a threaded feature, such as an internal thread (not shown). When an operator adjusts the first adjusting member 122 through the first operation hole 130 of the housing 54, the first component 40 and the panel 36 are transversely (or laterally) displaced due to threaded engagement between the threaded feature 128 of the first adjusting member 122 and the threaded feature of the post 136. In other words, the transverse (or lateral) position of the panel 36 can be adjusted in relation to the base 14, the second component 44, or the sidewall 34.

Figures 15, 16:
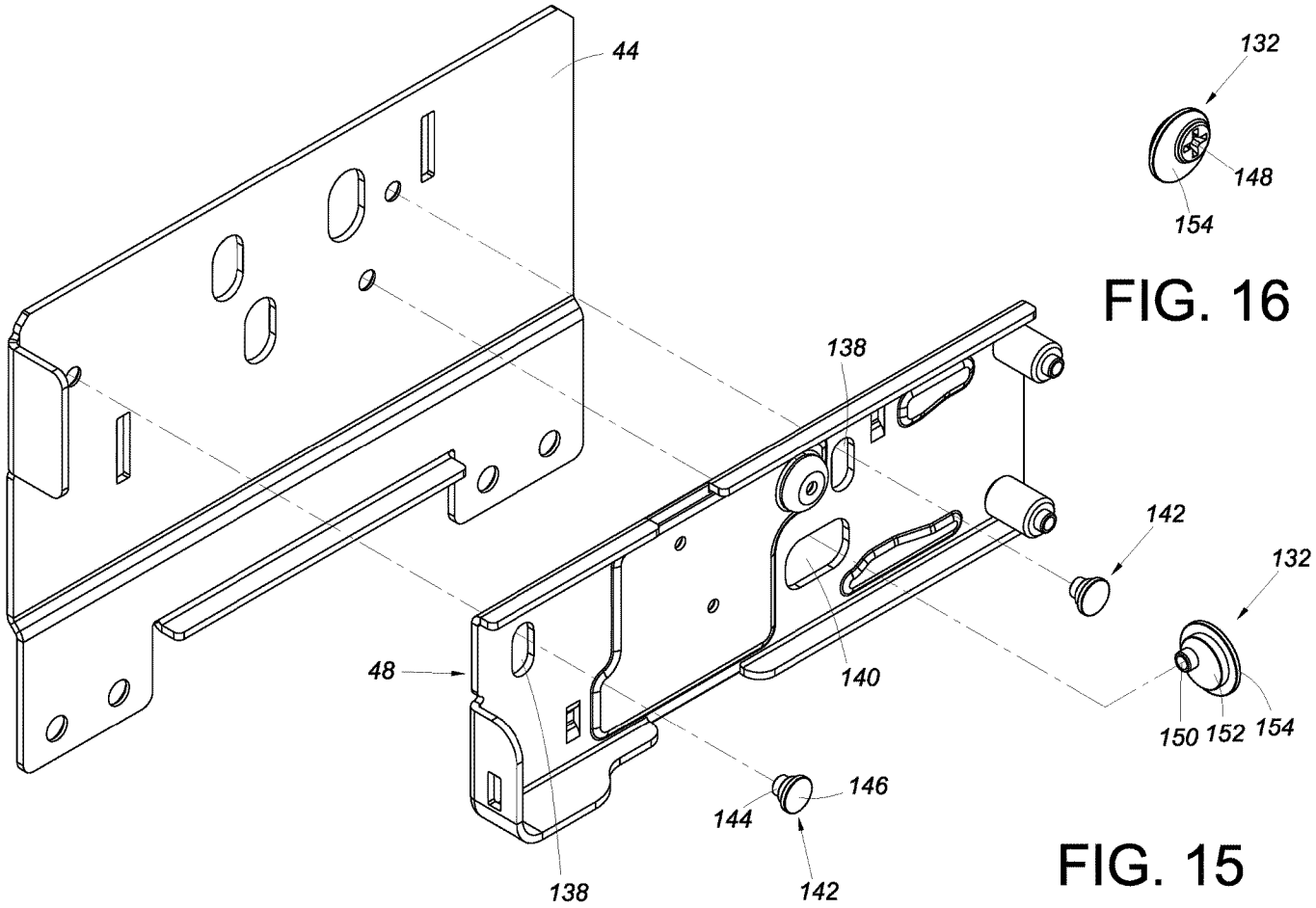
FIG. 15 is an exploded perspective view of the second component, the base, and the second adjusting member in the embodiment of FIG. 1.
FIG. 16 shows the second adjusting member in FIG. 15 from a different viewpoint.

Referring to FIG. 15, the base 48 has a plurality of first holes 138 and a second hole 140. The first holes 138 and the second hole 140 are so shaped that the latter is substantially perpendicular to the former. In this embodiment, the first holes 138 extend vertically while the second hole 140 extends in the longitudinal direction of the base 48. The mounting mechanism 46 further includes a plurality of guiding members 142. Each guiding member 142 corresponds to one of the first holes 138. More specifically, each guiding member 142 has a connecting portion 144 and a stop 146 connected to the connecting portion 144. The connecting portion 144 of each guiding member 142 is configured to pass through the corresponding first hole 138 of the base 48 and connect to the second component 44, with the stop 146 of the guiding member 142 stopped on one side of the base 48. Further, the connecting portion 144 of each guiding member 142 is smaller than the length of each first hole 138, allowing the base 48 to be movably mounted on the second component 44.

As shown in FIG. 15 and FIG. 16, the second adjusting member 132 includes an adjusting portion 148, a pivotal connection portion 150, and an eccentric portion 152 connected between the adjusting portion 148 and the pivotal connection portion 150. The adjusting portion 148 and the pivotal connection portion 150 have a common axis, and the eccentric portion 152 is eccentric with respect to the axis. In other words, the center of the eccentric portion 152 is shifted away from the centers of the adjusting portion 148 and the pivotal connection portion 150. Preferably, the second adjusting member 132 further includes a stop 154 to be stopped on one side of the base 48. The pivotal connection portion 150 is passed through the second hole 140 of the base 48 in order to connect pivotally with the second component 44. The eccentric portion 152 is designed to correspond to the second hole 140 of the base 48.

Figures 17, 18, 19:
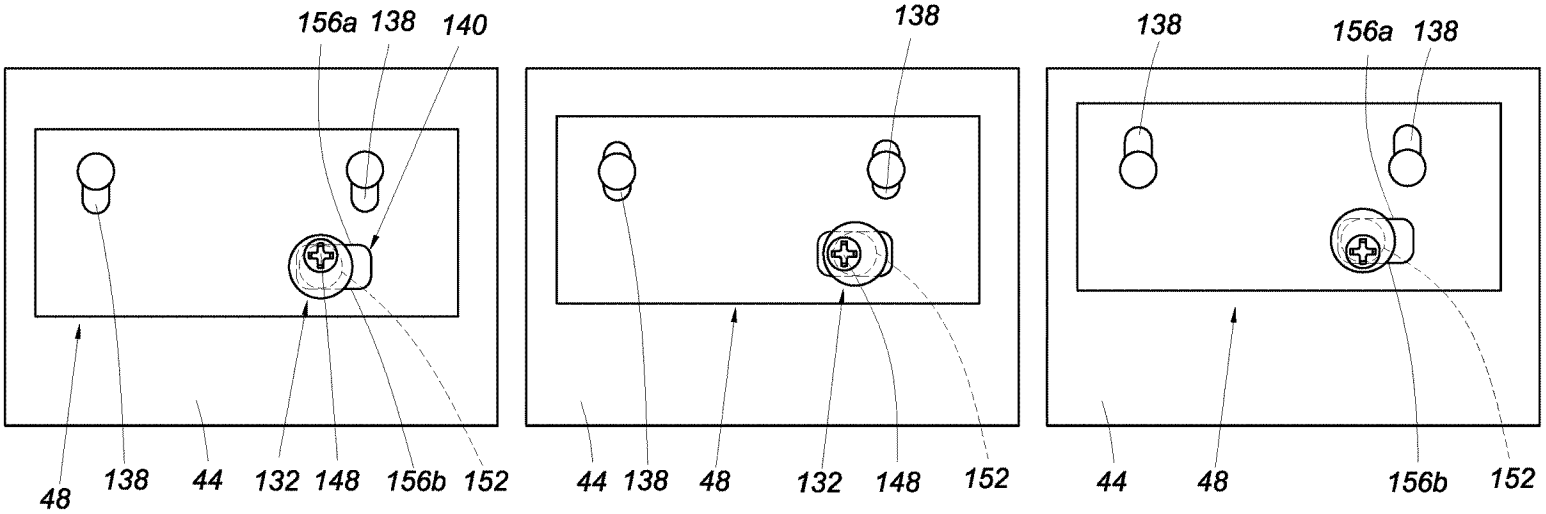
FIG. 17 schematically shows that the base of the mounting mechanism can be adjusted to a first position with respect to the second component by adjusting the second adjusting member.
FIG. 18 schematically shows that the base of the mounting mechanism can be adjusted to a second position with respect to the second component by adjusting the second adjusting member.
FIG. 19 schematically shows that the base of the mounting mechanism can be adjusted to a third position with respect to the second component by adjusting the second adjusting member.

As shown in FIG. 17, FIG. 18, and FIG. 19, the base 48 can be displaced upward and downward by adjusting the second adjusting member 132. More specifically, when the adjusting portion 148 is adjusted, the eccentric portion 152 pushes an upper wall 156*a* or a lower wall 156*b* of the second hole 140 of the base 48 such that the base 48 is displaced upward (see FIG. 19) or downward (see FIG. 17) with respect to the second component 44 from the state of FIG. 18 according to the vertical shape of the first holes 138. Thus, referring also to FIG. 20, when the panel 36 is mounted to the movable member 52 on the base 48 through the first component 40, the panel 36 can be adjusted upward and downward with respect to the second component 44 or the sidewall 34 by adjusting the base 48 upward and downward.

Figure 20:
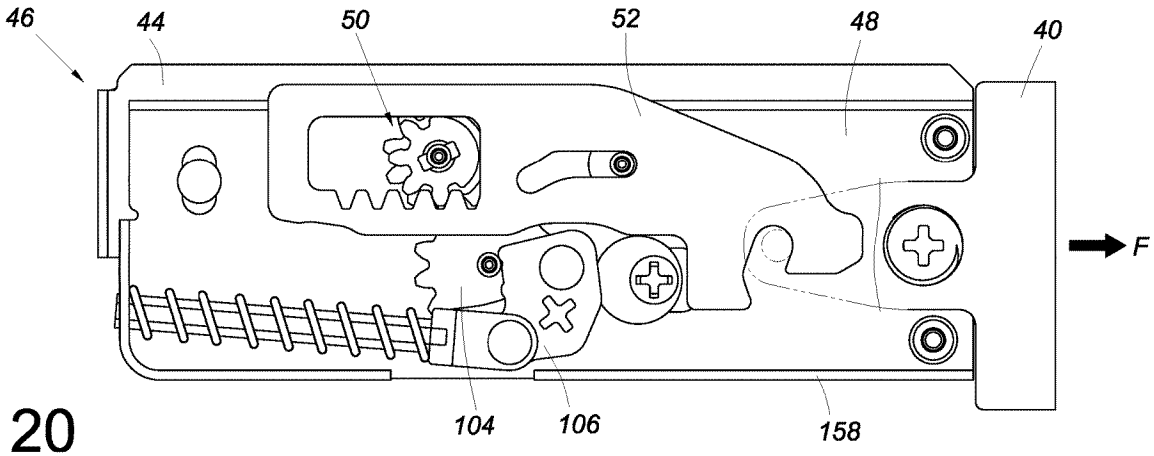
FIG. 20 schematically shows that an external force of a certain direction is applied to the first component in FIG. 2 after the first component is mounted to the second component.
Figure 21:
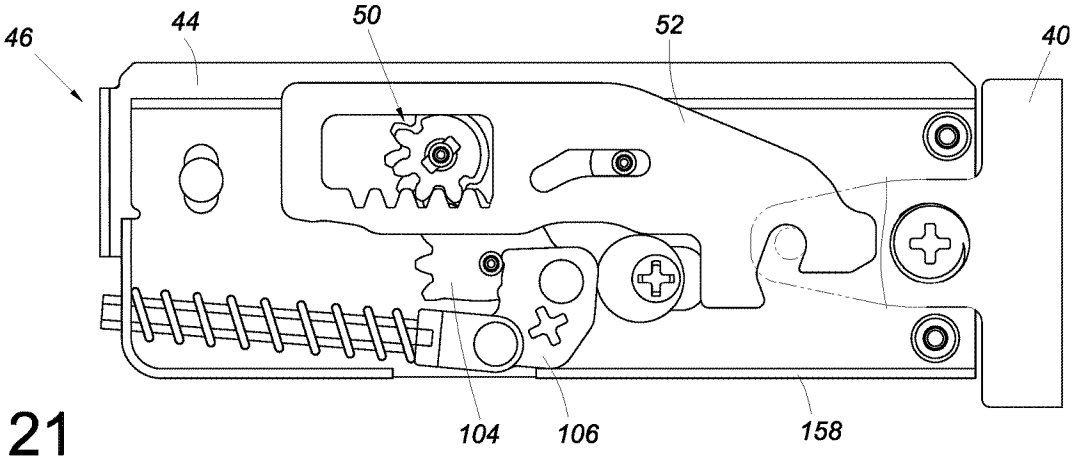
FIG. 21 schematically shows how the second linking member is driven and consequently pressed against a stop wall by the first component in FIG. 20 due to the external force applied to the first component.

As shown in FIG. 20 and FIG. 21, the mounting mechanism 46 in this embodiment may include a stop wall 158 connected to the base 48 and adjacent to the second linking member 106. When the first component 40 is mounted on the second component 44, an external force F applied to the first component 40 in the opposite direction of the aforesaid direction D will pull the movable member 52 together with the first component 40; as a result, the transmission device 50, the first linking member 104, and the second linking member 106 are also driven. In particular, once the second linking member 106 is driven, in response to the external force F, to be stopped at the stop wall 158, the first component 40 can be prevented from being pulled out with respect to the second component 44, and this ensures that the first component 40 is mounted on the second component 44 in a reliable manner.

Figure 23:
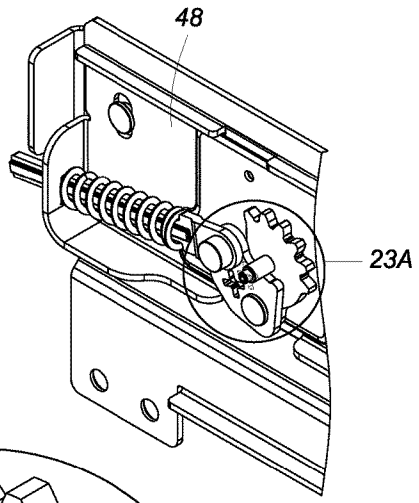
FIG. 23 shows the mounting mechanism in FIG. 22 in the assembled state.
Figure 23A:
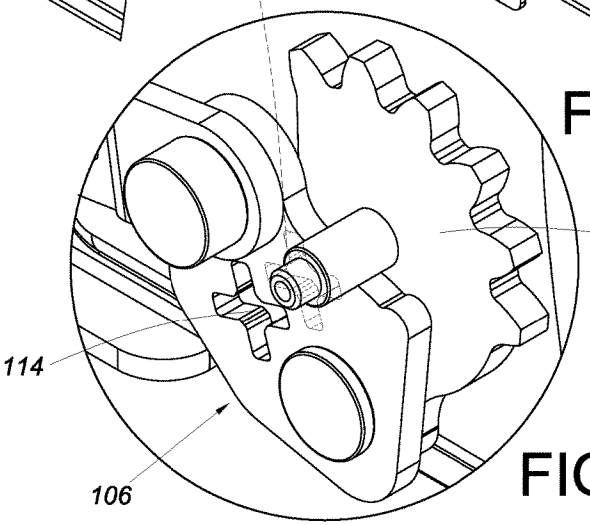
FIG. 23A is a partial enlarged view of FIG. 23, showing in particular the manual operation portion corresponding in position to the stopping feature.
Figure 22:
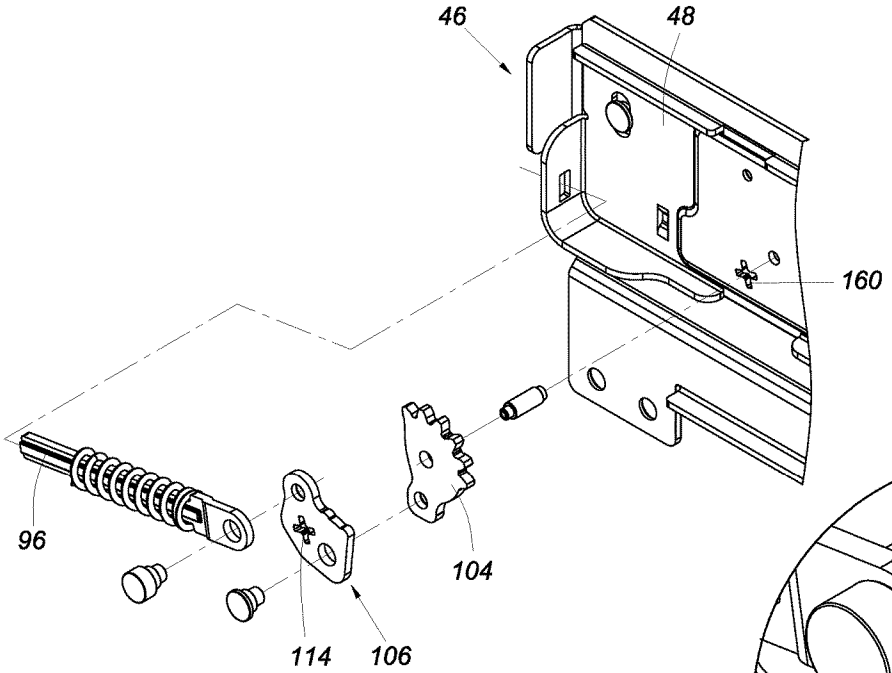
FIG. 22 is a partial exploded perspective view of the mounting mechanism in the embodiment of FIG. 1.

As shown in FIG. 22, FIG. 23, and FIG. 23A, the mounting mechanism 46 further includes a stopping feature 160, such as a stop wall arranged at the base 48. When the second linking member 106 is in a predetermined state and at a certain position (referring to the state of the second linking member 106 in FIG. 8 and FIG. 9 for the predetermined state), the manual operation portion 114 of the second linking member 106 corresponds in position to the stopping feature 160 of the base 48. If, in this state, a tool such as a screw driver (not shown) is inserted into the manual operation portion 114 of the second linking member 106 and turned, the front end portion of the screw driver will be stopped by the stopping feature 160 of the base 48, making it impossible for the screw driver to rotate the second linking member 106. This ensures that the related components such as the first linking member 104 and the connecting rod 96 stay in the predetermined state with respect to the second linking member 106.

Figure 24:
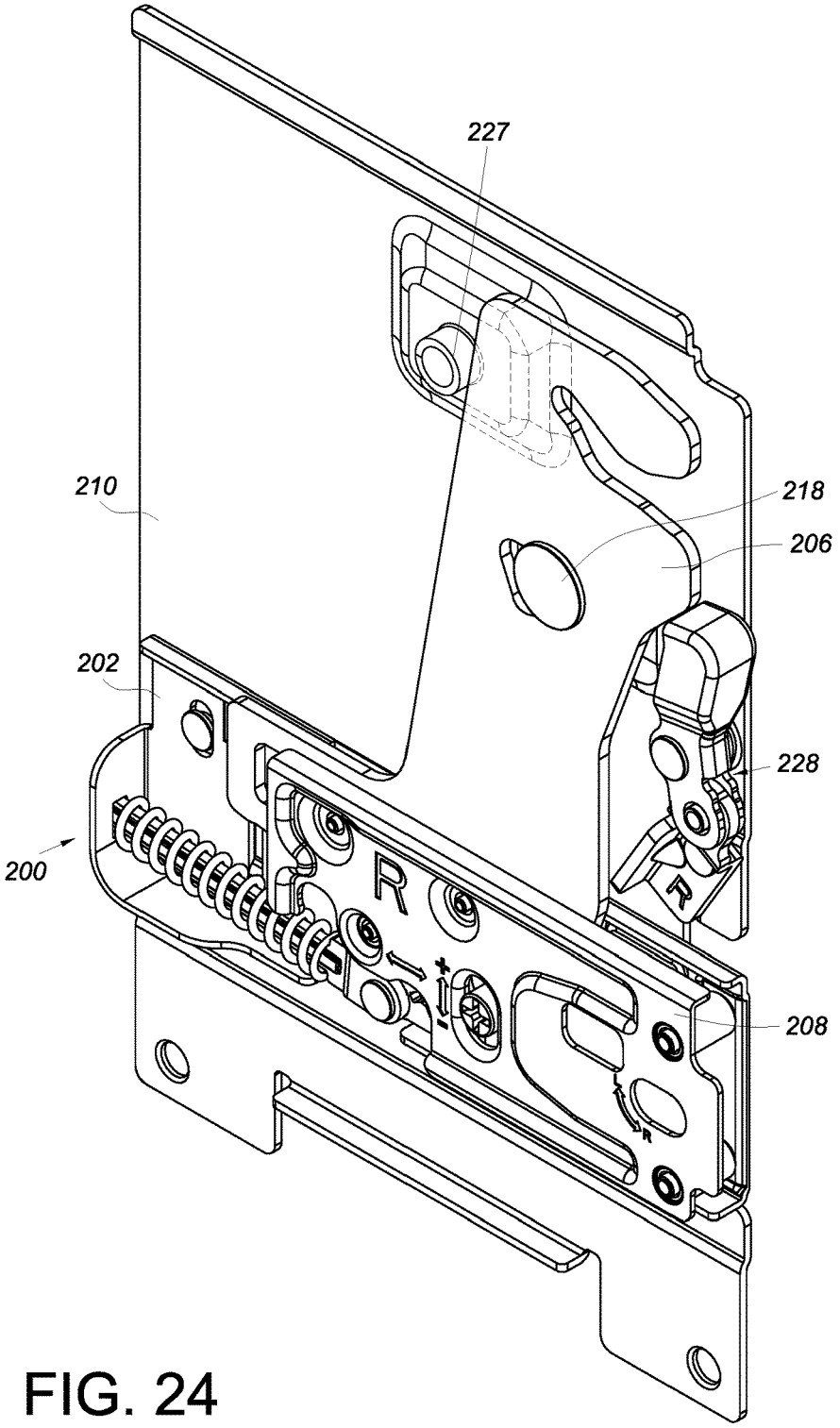
FIG. 24 is an assembled perspective view of the mounting mechanism in another embodiment of the present invention.
Figure 25:
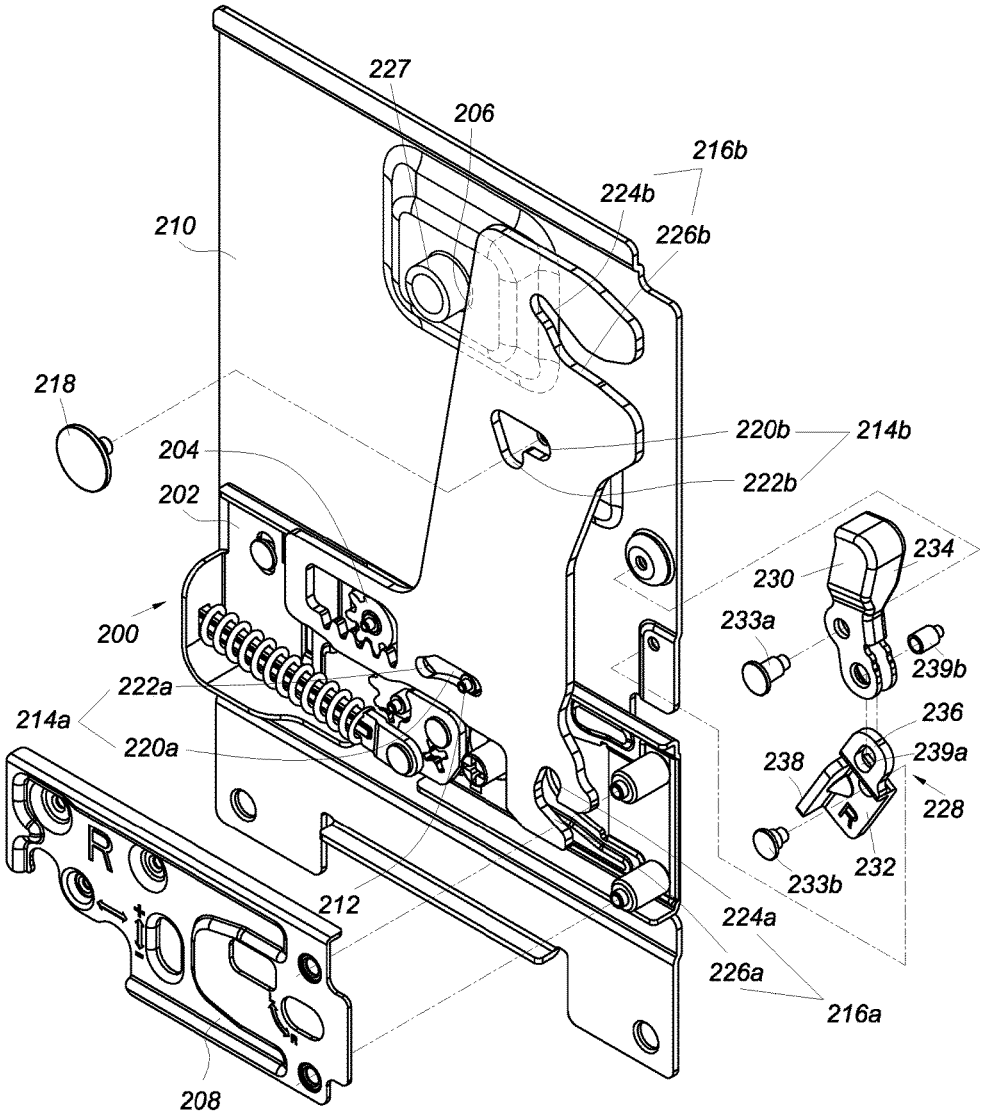
FIG. 25 is an exploded perspective view of the mounting mechanism in FIG. 24.

FIG. 24 and FIG. 25 show the mounting mechanism 200 in another embodiment of the present invention. The mounting mechanism 200 includes a base 202, a transmission device 204, and a movable member 206. Preferably, a housing 208 is also included. The base 202 is configured in generally the same way as its counterpart in the previous embodiment and is mounted on a second component 210. A protruding member 212 is arranged at the base 202. The transmission device 204 and the housing 208 are configured in generally the same way as their respective counterparts in the previous embodiment. The movable member 206 is also configured in generally the same way as its counterpart in the previous embodiment except that the movable member 206 includes two guiding portions 214*a*, 214*b* and two holding portions 216*a*, 216*b*. The two guiding portions 214*a*, 214*b* are configured to be inserted by the protruding member 212 and a rod member 218 respectively, wherein the rod member 218 is coupled to the second component 210. Each guiding portion 214*a*, 214*b* has a first channel 220*a*, 220*b* and a second channel 222*a*, 222*b*. Each second channel 222*a*, 222*b* is in communication with and is tilted by an angle with respect to the corresponding first channel 220*a*, 220*b*. In this embodiment, the movable member 206 is longitudinally extended, and integrally formed, with the two holding portions 216*a*, 216*b*. Each holding portion 216*a*, 216*b* includes an engaging section 224*a*, 224*b* and a guiding surface 226*a*, 226*b* adjacent to the engaging section 224*a*, 224*b*. In a preferred embodiment, the second component 210 has a stop 227 against which a portion of the movable member 206 can be pressed.

Figure 26:
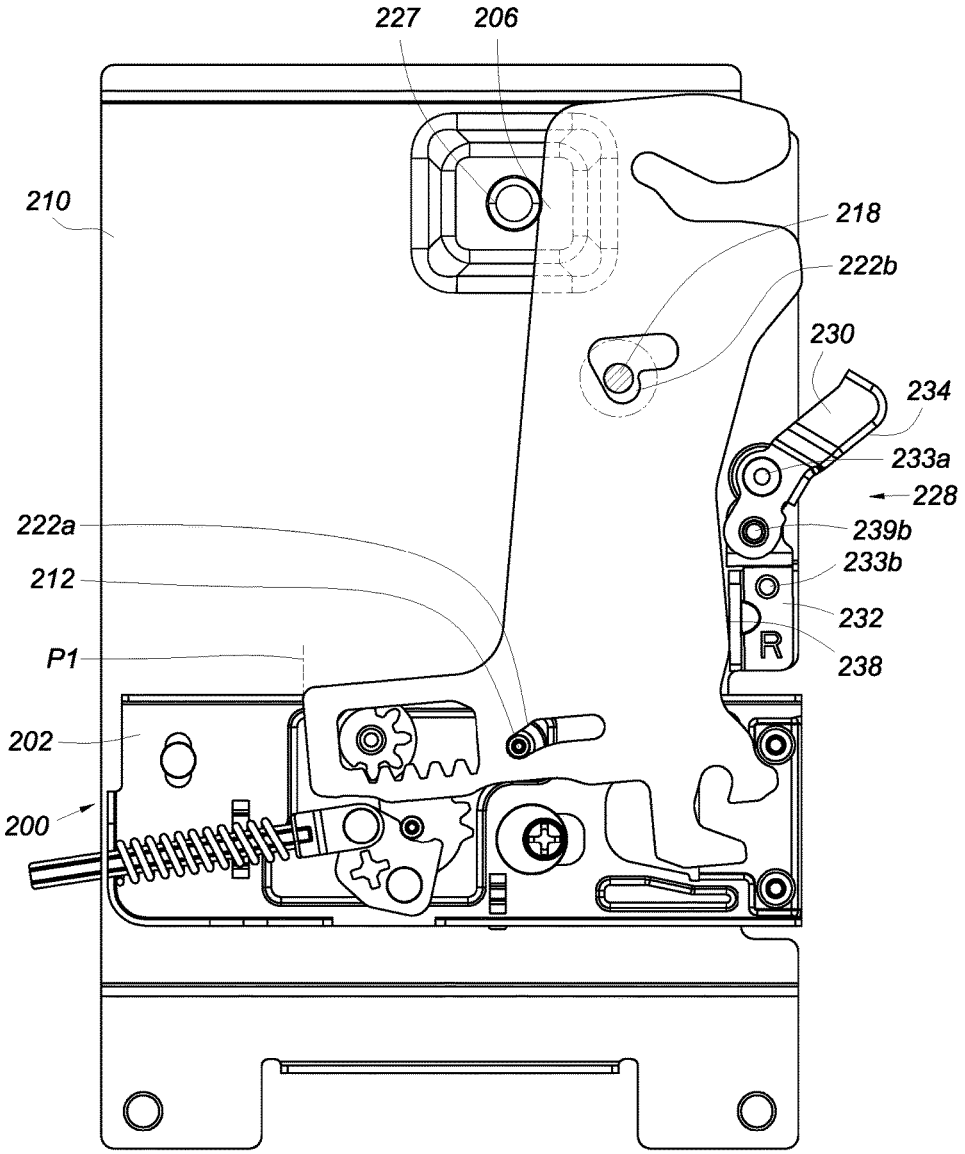
FIG. 26 is a plan view showing the mounting mechanism in FIG. 24 in a predetermined state.

As shown in FIG. 25 and FIG. 26, the mounting mechanism 200 preferably further includes a driving device 228 mounted on the second component 210. The driving device 228 includes a driving member 230 and a pushing member 232. The driving member 230 and the pushing member 232 are pivotally connected to the second component 210 by pivotal connection members 233*a*, 233*b* respectively. The driving member 230 has a first abutting portion 234. The pushing member 232 has a linking portion 236 and a second abutting portion 238. The linking portion 236 is movably connected to the driving member 230. The second abutting portion 238 corresponds to the movable member 206. More specifically, the pushing member 232 has a slot 239*a* and is pivotally connected to the driving member 230 by a rod element 239*b* movably passing through the slot 239*a*. The pushing member 232 and the driving member 230, however, are not necessarily pivotally connected; they may be connected by meshing or by mechanical engagement instead.

Referring to FIG. 26, when the protruding member 212 and the rod member 218 correspond to the second channels 222*a*, 222*b* of the movable member 206 respectively, the movable member 206 is at a first position P1 with respect to the base 202 for the time being. In this state, the movable member 206 is tilted with respect to the base 202, the first abutting portion 234 of the driving member 230 partially extends beyond the front end of the second component 210, and the second abutting portion 238 of the pushing member 232 is adjacent to the movable member 206.

Figure 27:
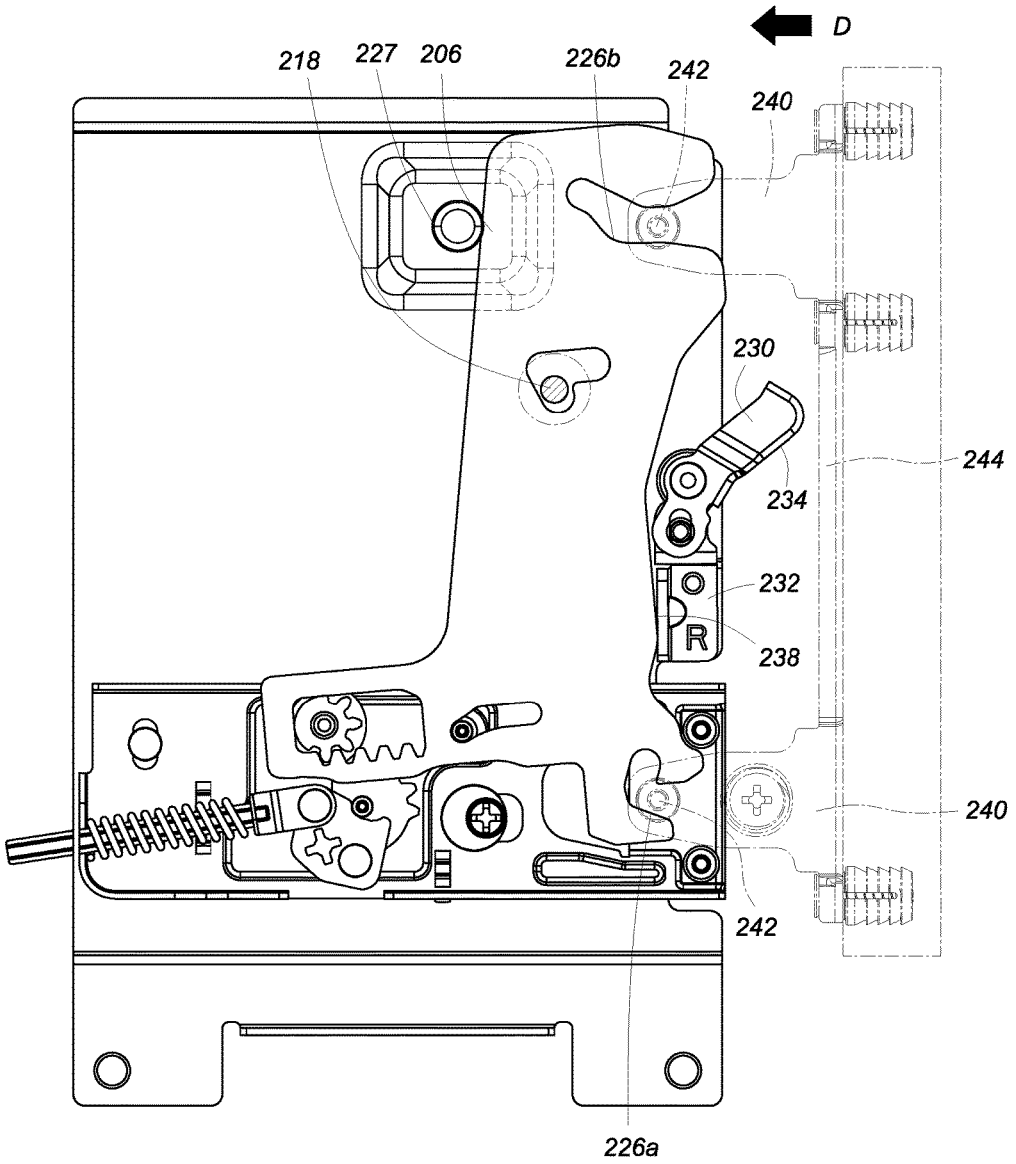
FIG. 27 is similar to FIG. 26, showing the first step of mounting two first components to the mounting mechanism.

Referring to FIG. 27, this embodiment allows two first components 240 to be mounted, wherein each first component 240 is configured in generally the same way as its counterpart in the previous embodiment and has such features as an auxiliary portion 242. In this embodiment, the two first components 240 are connected by a connecting member 244. The operation of mounting the two first components 240 begins by moving them in a predetermined direction D. As shown in FIG. 27, the auxiliary portions 242 of the two first components 240 push the guiding surfaces 226*a*, 226*b* of the movable member 206 respectively while being moved in the direction D. On the other hand, the connecting member 244 between the two first components 240 pushes the first abutting portion 234 of the driving member 230, and the pushing member 232 is pivoted in response to the driving member 230. The movable member 206, therefore, is pushed by the second abutting portion 238 of the pushing member 232. With a portion of the movable member 206 pressed against the stop 227 of the second component 210, a better supporting effect is achieved during the mounting operation.

Figure 28:
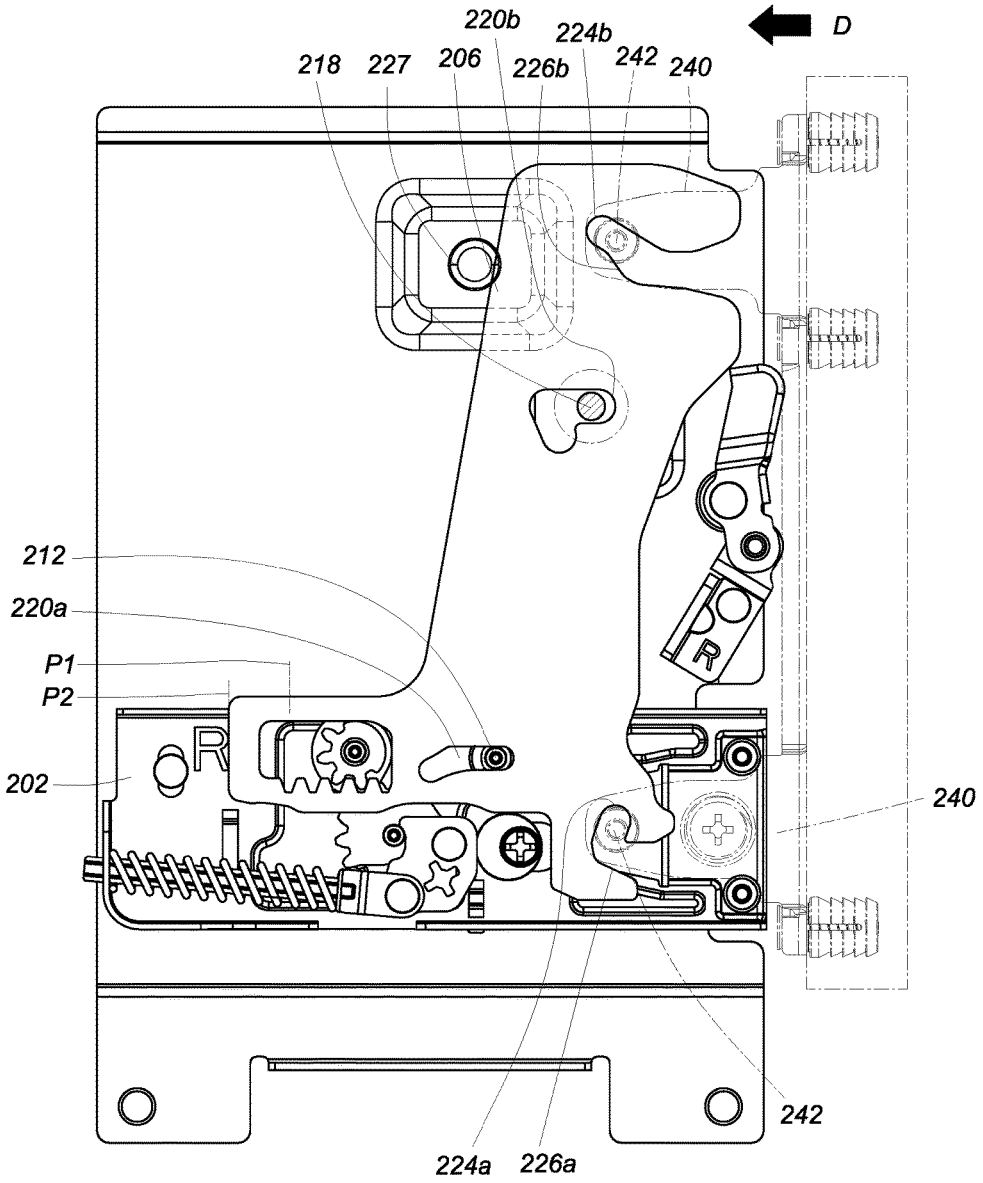
FIG. 28 is similar to FIG. 27, showing the second step of mounting two first components to the mounting mechanism.

Referring to FIG. 28, as the auxiliary portions 242 of the first components 240 continue pushing the guiding surfaces 226*a*, 226*b* of the movable member 206 in the direction D respectively, the movable member 206 is displaced in the same direction from the first position P1 to a second position P2 such that the protruding member 212 and the rod member 218 correspond to the first channels 220*a*, 220*b* of the movable member 206 respectively. The movable member 206 in this state is no longer tilted with respect to the base 202, and this allows the two first components 240 to be mounted to the movable member 206. In this embodiment, the two first components 240 are respectively and engageably mounted to the engaging sections 224*a*, 224*b* of the movable member 206 via the auxiliary portions 242 (the principle of interaction between the movable member and the transmission device can be easily understood by referring sequentially to FIG. 8, FIG. 9, FIG. 10, and FIG. 11 and is therefore omitted herein for the sake of simplicity).

While the present invention has been disclosed by way of the foregoing preferred embodiments, the embodiments are not intended to be restrictive of the scope of the invention. The scope of patent protection sought by the applicant is defined by the appended claims.

What is claimed is:

1. A mounting mechanism adapted for mounting at least one first component to a second component, the mounting mechanism comprising:

a base mountable on the second component;

a transmission device arranged at the base;

a movable member movably connected to the transmission device, wherein the movable member is configured to be displaced with respect to the base from a first position to a second position in response to displacement between the at least one first component and the second component in a predetermined direction, thereby mounting the at least one first component to the second component;

a connecting rod and an elastic member, wherein the elastic member is mounted on the connecting rod and is configured to apply an elastic force to the movable member; and an extension wall connected to the base, the extension wall having a mounting feature, the connecting rod having a head and a body connected to the head, the body partially extending out of the mounting feature, the elastic member being pressed between the extension wall and the head;

wherein the transmission device includes a second transmission member with a plurality of second teeth, the mounting mechanism further includes a first linking member and a second linking member, the first liking member is pivotally connected to the base and includes a plurality of teeth meshing with the second teeth of the second transmission member, and the second linking member is movably connected between the first linking member and the head of the connecting rod.

2. The mounting mechanism of claim 1, wherein the transmission device includes a first transmission member with a plurality of first teeth, and the movable member includes a rack meshing with the first teeth of the first transmission member.

3. The mounting mechanism of claim 1, wherein the second linking member includes a manual operation portion with which the second linking member is manually adjustable in order to bring the movable member from the second position to the first position with respect to the base.

4. The mounting mechanism of claim 3, further comprising a stopping feature arranged at the base, wherein the manual operation portion of the second linking member corresponds in position to the stopping feature when the second linking member is at a predetermined position.

5. The mounting mechanism of claim 1, further comprising a stop wall adjacent to the second linking member, wherein the stop wall stops the second linking member in response to an external force applied in an opposite direction of the predetermined direction to the at least one first component.

6. The mounting mechanism of claim 1, wherein the movable member includes a guiding portion, the guiding portion has a first channel and a second channel in communication with and tilted by an angle with respect to the first channel, the mounting mechanism further includes a protruding member selectively extending through a corresponding one of the first channel and the second channel, and the movable member is at the first position with respect to the base when the protruding member corresponds to the second channel.

7. The mounting mechanism of claim 1, wherein the movable member includes a holding portion, the holding portion includes an engaging section and a guiding surface adjacent to the engaging section, and an auxiliary portion of the at least one first component is allowed to push the guiding surface of the movable member and to be engageably mounted to the engaging section.

8. The mounting mechanism of claim 1, wherein the at least one first component includes two corresponding longitudinal walls and an auxiliary portion connected between the two longitudinal walls; one of the two longitudinal walls of the at least one first component has a post; the auxiliary portion is mountable to the movable member; a first adjusting member is arranged at the at least one first component and includes an adjusting portion, a pushing portion, and a threaded feature connected between the adjusting portion and the pushing portion; the threaded feature is threadedly connectable to the post; the pushing portion corresponds to the base; and the at least one first component is displaceable in a transverse direction according to adjustment of the first adjusting member.

9. The mounting mechanism of claim 1, wherein the base includes a first hole and a second hole; the second hole has a shape substantially perpendicular to a shape of the first hole; the mounting mechanism further comprises a guiding member and a second adjusting member; the guiding member has a connecting portion and a stop connected to the connecting portion; the connecting portion extends through the first hole and is connectable to the second component such that the stop is stopped on a side of the base; the second adjusting member corresponds to the second hole of the base and includes an adjusting portion, a pivotal connection portion, and an eccentric portion connected between the adjusting portion and the pivotal connection portion of the second adjusting member; the adjusting portion and the pivotal connection portion have a common axis; the pivotal connection portion is pivotally connectable to the second component; and the eccentric portion is eccentric with respect to the axis and is configured to push the base in order to displace the base according to the shape of the first hole.

10. The mounting mechanism of claim 1, wherein the first component is a first furniture component, and the second component is a second furniture component.

11. The mounting mechanism of claim 1, wherein the movable member includes two holding portions to which two first components are respectively and engageably mountable.

12. The mounting mechanism of claim 11, wherein each of the holding portions includes an engaging section and a guiding surface adjacent to the engaging section, and each of the two first components has an auxiliary portion for pushing a corresponding one of the guiding surfaces of the movable member and to be engageably mounted to a corresponding one of the engaging sections.

13. The mounting mechanism of claim 11, wherein the movable member includes two guiding portions, each of the guiding portions has a first channel and a second channel in communication with and tilted by an angle with respect to the first channel, the mounting mechanism further comprises a protruding member and a rod member, the protruding member and the rod member extend through the two guiding portions respectively, and the movable member is at the first position with respect to the base when the protruding member and the rod member each correspond to a corresponding one of the second channels.

14. The mounting mechanism of claim 11, further comprising a driving device mountable on the second component, wherein the driving device includes a pushing member, and when displaced in the predetermined direction the two first components drive the driving device such that the movable member is displaced from the first position toward the second position in response to pushing of the pushing member of the driving device.

15. The mounting mechanism of claim 14, wherein the driving device includes a driving member, both the driving member and the pushing member are pivotally connectable to the second component, the pushing member is movably connected to the driving member, and the driving member is configured to be driven by the two first components in order to drive the pushing member.

16. A mounting mechanism adapted for mounting at least one first component to a second component, the mounting mechanism comprising:

a base mountable on the second component;

a movable member movably mounted on the base, the movable member includes at least one holding portion to which the at least one first component is mountable; and a transmission device for displacing the movable member from a first position to a second position in response to the at least one first component being mounted to the holding portion of the movable member;

wherein the transmission device includes a first transmission member with a plurality of first teeth, and the movable member includes a rack meshing with the first teeth of the first transmission member;

wherein the transmission device includes a second transmission member with a plurality of second teeth, and the mounting mechanism further includes a first linking member with a plurality of teeth meshing with the second teeth of the second transmission member.

17. The mounting mechanism of claim 16, wherein the plurality of first teeth and second teeth are coaxially disposed with respect to the transmission device.

18. The mounting mechanism of claim 16, further comprising a second linking member and a connecting rod, the second linking member is movably connected between the first linking member and the connecting rod, and the connecting rod is mounted on the base.

19. The mounting mechanism of claim 18, further comprising an elastic member, wherein the elastic member is mounted on the connecting rod and is configured to apply an elastic force to the movable member.

20. The mounting mechanism of claim 16, wherein the movable member includes two holding portions to which two first components are respectively and engageably mountable.

21. The mounting mechanism of claim 20, wherein each of the holding portions includes an engaging section and a guiding surface adjacent to the engaging section, and each of the two first components has an auxiliary portion for pushing a corresponding one of the guiding surfaces of the movable member and to be engageably mounted to a corresponding one of the engaging sections.

22. The mounting mechanism of claim 20, wherein the movable member includes two guiding portions, each of the guiding portions has a first channel and a second channel in communication with and tilted by an angle with respect to the first channel, the mounting mechanism further comprises a protruding member and a rod member, the protruding member and the rod member extend through the two guiding portions respectively, and the movable member is at the first position with respect to the base when the protruding member and the rod member each correspond to a corresponding one of the second channels.

23. The mounting mechanism of claim 20, further comprising a driving device mountable on the second component, wherein the driving device has a pushing member, and when displaced in a predetermined direction the two first components drive the driving device such that the movable member is displaced from the first position toward the second position in response to pushing of the pushing member of the driving device.

24. The mounting mechanism of claim 23, wherein the driving device includes a driving member, both the driving member and the pushing member are pivotally connectable to the second component, the pushing member is movably connected to the driving member, and the driving member is configured to be driven by the two first components in order to drive the pushing member.

25. A mounting mechanism adapted for use in a system including a main body and an object mounted to the main body via a slide rail assembly, wherein the slide rail assembly includes a first rail and a second rail displaceable with respect to the first rail, the object includes a sidewall and a panel, the sidewall is arranged at the second rail, and the panel is mounted to a second component of the sidewall via a first component, the mounting mechanism comprising:

a base mountable on the second component;

a movable member mounted on the base, the movable member including a rack;

a transmission device for displacing the movable member from a first position to a second position in response to the first component being mounted to the movable member, wherein the transmission device includes a first transmission member with a plurality of first teeth and a second transmission member with a plurality of second teeth, and the first teeth of the first transmission member mesh with the rack of the movable member;

a first linking member pivotally connected to the base, the first linking member including a plurality of teeth meshing with the second teeth of the second transmission member; and a second linking member connected to the first linking member;

wherein the second linking member is connected to a connecting rod, and an elastic member is mounted on the connecting rod and is configured to apply an elastic force to the movable member.

* * * * *